US008109493B2

(12) United States Patent
Koskovich et al.

(10) Patent No.: US 8,109,493 B2
(45) Date of Patent: Feb. 7, 2012

(54) AUTOMATED TRUSS ASSEMBLY JIG SETTING SYSTEM

(75) Inventors: Jerome E. Koskovich, Byron, MN (US); James Edward McKeon, Mazeppa, MN (US); Timothy Louis Meyer, Zumbrota, MN (US)

(73) Assignee: Mitek Holdings, Inc., Wilmington, DE (US)

( * ) Notice: Subject to any disclaimer, the term of this patent is extended or adjusted under 35 U.S.C. 154(b) by 1210 days.

(21) Appl. No.: 11/760,448

(22) Filed: Jun. 8, 2007

(65) Prior Publication Data

US 2007/0283546 A1 Dec. 13, 2007

Related U.S. Application Data

(60) Provisional application No. 60/804,244, filed on Jun. 8, 2006.

(51) Int. Cl.
*B25B 1/20* (2006.01)

(52) U.S. Cl. ..... 269/37; 269/910

(58) Field of Classification Search ..... 269/37, 269/45, 289 R, 295, 910; 74/89.23; 82/163; 409/238; *B23P 17/04*

See application file for complete search history.

(56) References Cited

U.S. PATENT DOCUMENTS

| | | | | |
|---|---|---|---|---|
| 4,009,599 A | | 3/1977 | Patriquin | |
| 4,627,564 A | | 12/1986 | Bowser | |
| 4,943,038 A | * | 7/1990 | Harnden | 269/37 |
| 5,092,028 A | | 3/1992 | Harnden | |
| 5,342,030 A | | 8/1994 | Taylor | |
| 5,388,318 A | | 2/1995 | Petta | |
| 5,425,607 A | | 6/1995 | Hardesty | |
| 5,430,662 A | | 7/1995 | Ahonen | |
| 5,676,358 A | * | 10/1997 | Shamblin et al. | 269/37 |
| 5,702,095 A | | 12/1997 | Williams | |
| 5,854,747 A | | 12/1998 | Fairlie | |
| 5,947,460 A | | 9/1999 | Williams | |
| 6,170,163 B1 | | 1/2001 | Bordignon et al. | |
| 6,317,980 B2 | | 11/2001 | Buck, III | |

(Continued)

FOREIGN PATENT DOCUMENTS

EP 1864769 B1 5/2010

OTHER PUBLICATIONS

European Search Report regarding application No. EP 07 10 9942, 3 pages. EPO Search Report regarding EP 07 10 9942 dated Sep. 20, 2007, 7 pages.

*Primary Examiner* — Lee D Wilson
*Assistant Examiner* — Jamal Daniel
(74) *Attorney, Agent, or Firm* — Senniger Powers LLP

(57) ABSTRACT

The invention as depicted in a preferred embodiment is a retrofitted automated truss assembly jig setting system and one or more removable plank units used therewith. Removable plank unit includes a pair of drive motors each connected to a motor plate that is fixed to the bottom surface of a plank. A pair of rods extends along the length of the plank and each is operatively connected to a motor such that activation of a motor rotates a rod. Puck assemblies are carried by rods and are linearly transposed along rods when motors are activated. A computerized control system is operatively connected to provide for automated positioning of pucks. Planks on existing truss assembly tables may be removed and replaced with removable plank units to turn a traditional truss assembly jigging table into an automated truss assembly jigging table.

24 Claims, 23 Drawing Sheets

U.S. PATENT DOCUMENTS 6,712,347 B1 3/2004 Fredrickson et al.
6,807,903 B2 10/2004 Anderson
6,899,324 B2 * 5/2005 Fredrickson et al. ..... 269/37
2005/0121844 A1 6/2005 Fredrickson et al.
2005/0212192 A1 9/2005 Fredrickson et al.
2008/0084014 A1 * 4/2008 Godwin et al. ..... 269/37

* cited by examiner

AUTOMATED TRUSS ASSEMBLY JIG SETTING SYSTEM

CROSS-REFERENCE TO RELATED APPLICATION

The present application claims priority to U.S. Provisional Application No. 60/804,244, filed Jun. 8, 2006 and entitled Automated Truss Assembly Jig Setting System, the entirety of which is herein incorporated by reference.

FIELD OF THE INVENTION

The present invention relates generally to assembling trusses and more particularly to an automated truss assembly jig setting system.

BACKGROUND OF THE INVENTION

Prefabricated trusses are often used in the construction of buildings because of their strength, reliability, low cost, and ease of use. An increase in the use of more complex and varied trusses, however, has created manufacturing problems and increased production times.

Trusses are generally assembled on a jigging table. Jigging tables typically have a plurality of adjustable stops, or pucks, for indicating the proper positions of the elements of a truss and for holding these elements in position until they can be permanently secured together. The pucks must be repositioned on the jig surface for each different truss. Computer programs generally calculate the position of the pucks from a reference line, such as the edge of the table. Conventionally, an operator would measure the positions of the pucks from the reference line, manually move and secure the pucks into the desired positions, place the truss elements on the table against the pucks, fasten them together, remove the completed truss, and then repeat. Due to great variation and complexity in modern truss designs, a significant amount of production time is spent resetting the positions of the pucks and there is a high likelihood of operator error. Various approaches have been developed to enhance this process.

One method that has been developed to increase production efficiency in truss assembly is laser projection. This approach projects the image of a desired truss in actual shape and size onto a jig table. The pucks of the jig table are then simply moved to their corresponding locations as indicated by the laser projection. This minimizes or eliminates the measurement time needed with conventional systems and ensures accurate placement of the pucks. Known laser truss assembly systems are disclosed in U.S. Pat. No. 5,430,662 to Ahonen, U.S. Pat. No. 6,317,980 to Buck and U.S. Pat. No. 6,170,163 to Bordignon et al, which are hereby incorporated by reference. However, these types of systems do not eliminate the need to repeatedly secure and loosen the pucks for each truss design. Although effective in increasing the correctness of assembled trusses, the time it takes for an operator to manually position the pucks with their corresponding projected image is significant.

Another approach employs a system that automatically moves the pucks along the surface of the jig. Such systems are disclosed in U.S. Pat. No. 5,854,747 to Fairlie, U.S. Pat. No. 6,712,347 to Fredrickson et al, and U.S. Pat. No. 5,342,030 to Taylor, which are hereby incorporated by reference. The goal of such systems is speed and efficiency greater than prior systems such as manual jig tables and laser projection. For example, the '347 patent criticizes prior laser projection systems as being too slow and expensive. While these systems may speed up the process, they tend to suffer reliability and consistency issues. Because trusses are often made from wood, sawdust and wood chips often pile up on the jigging table. This debris can fall into the slots in which the pucks move, hampering or preventing the pucks from reaching their proper position or preventing the pucks from being properly secured. An operator assembling a truss based on faulty positioning caused by one of these problems may fail to notice when one of the pucks is not in its proper place, possibly leading to an entire batch of improperly aligned trusses. In addition, any error by the software or hardware system controlling the pucks is not likely to be caught by an operator as there is nothing to indicate that there are pucks that are not properly aligned.

Existing jigging tables are not readily modifiable to laterally move the puck slots with respect to the overall table. Instead, the slots and the associated pucks are formed integrally with the table and cannot be readily moved. Thus, the flexibility of the table is restricted. Moreover, in known dual puck systems, the two pucks cannot pass each other.

Further, although speed and efficiency can be increased with use of such an automated truss assembly table, it often requires a large initial investment to completely replace all existing manual equipment for the automated equipment and a significant prior capital expenditure is wasted in discarding the previously used tables. Accordingly, it would be desirable to be able to easily convert a manual truss assembly table into an automated truss assembly table.

SUMMARY OF THE INVENTION

In one aspect of the present invention, a plank unit for use with a truss assembly jigging table generally comprises a plank having a generally planar top surface, and a drive motor secured to the plank. The drive motor has a rotating output member. A puck assembly includes a puck extending above the top surface of the plank. The puck assembly is operatively coupled to the rotating output member of the motor so that rotational movement of the output member produces translational movement of the puck assembly lengthwise along the top surface of the plank.

In another aspect, a truss assembly jigging table generally comprises a table frame, and a plurality of plank units held within the table frame. At least one plank unit is a removable plank unit. The removable plank unit includes a plank comprising a top surface and opposing bottom surface, first and second opposing side surfaces and first and second opposing ends. A plate member extends outwardly from the bottom surface of the plank. A rod is attached to the plate member and runs lengthwise along the plank. A drive motor is attached to the plate member and is configured to rotate the rod. A puck assembly is carried by the rod such that translational motion of the puck assembly is effected when the rod is rotated.

In yet another aspect, a method of converting a manual truss assembly jigging table into an automated truss assembly jigging table generally comprises the steps of removing a plank from a truss assembly jigging table, and inserting a removable plank unit into the space previously occupied by the plank. The removable plank unit comprises a plank having a top surface, and a drive motor secured to the plank. The drive motor has a rotating output member and a puck assembly including a puck extending above the top surface of the plank. The puck assembly is operatively coupled to the rotating output member of the motor so that rotational movement of the output member produces translational movement of the puck assembly lengthwise along the top surface of the plank. The removable plank unit is secured to the truss assembly jigging table.

BRIEF DESCRIPTION OF THE DRAWINGS

The invention may be more completely understood in consideration of the following detailed description of various embodiments of the invention in connection with the accompanying drawings, in which.

Corresponding reference characters indicate corresponding parts throughout the several views of the drawings.

DETAILED DESCRIPTION

Figure 1:
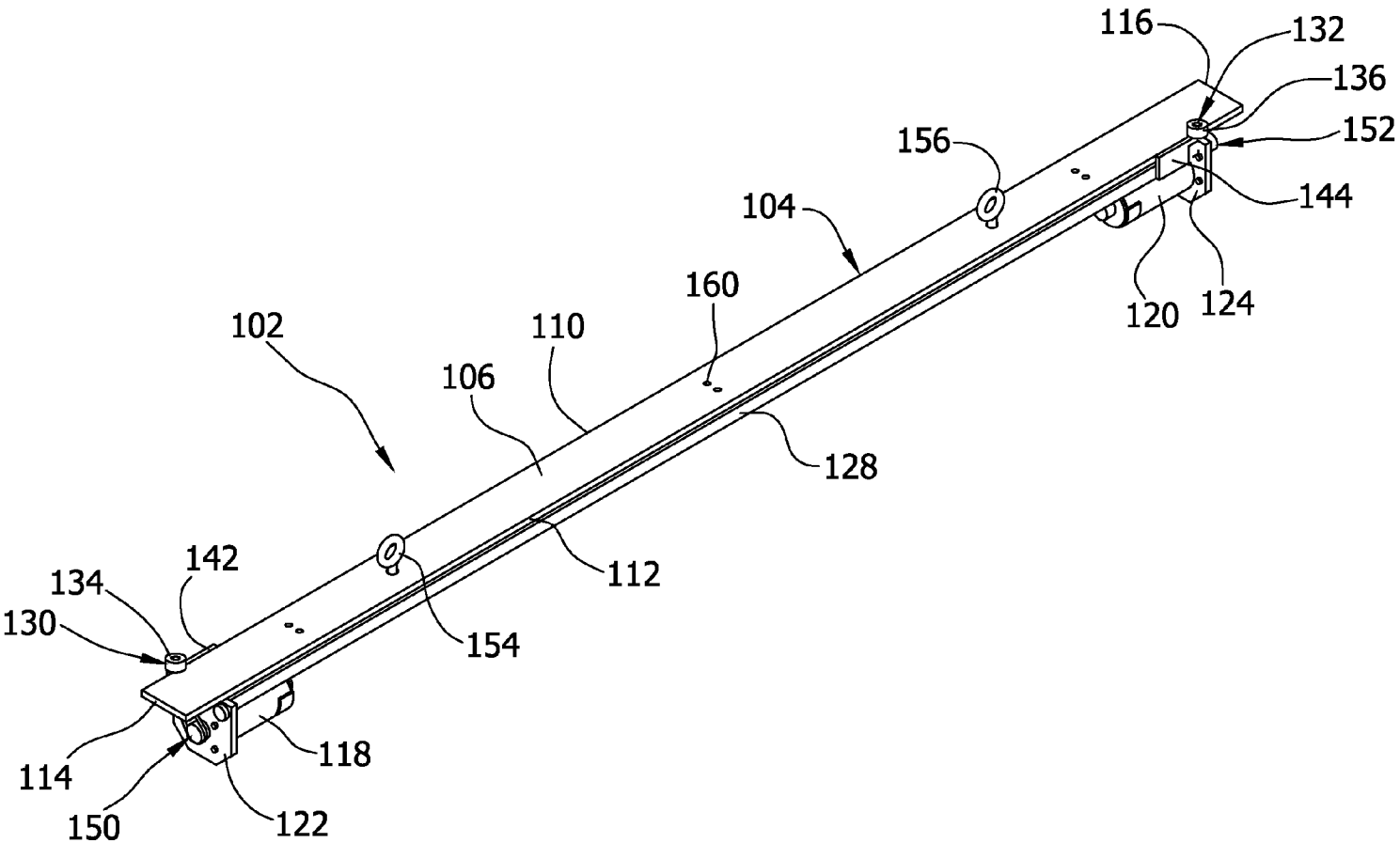
FIG. 1 is a perspective view of a removable plank unit according to an embodiment of the present invention.
Figure 2:
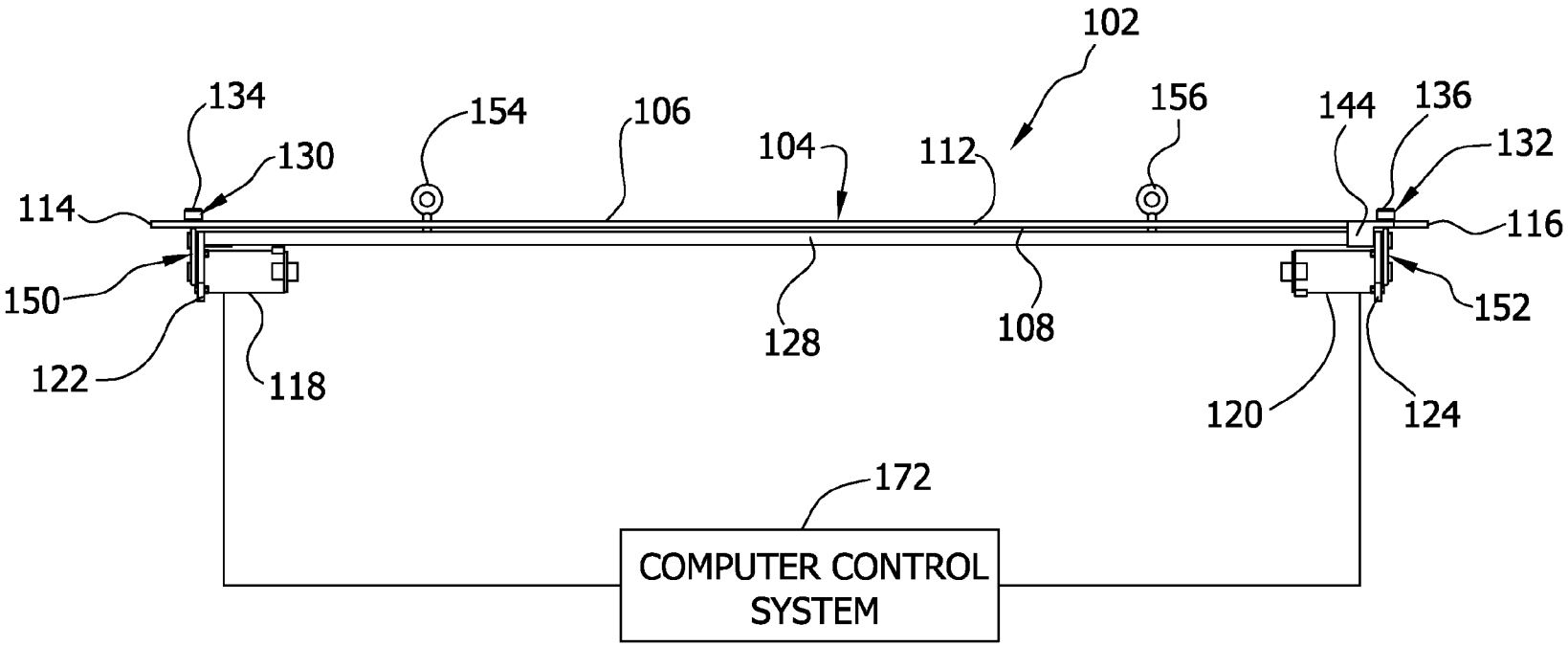
FIG. 2 is a side elevation of the removable plank unit.
Figure 3:
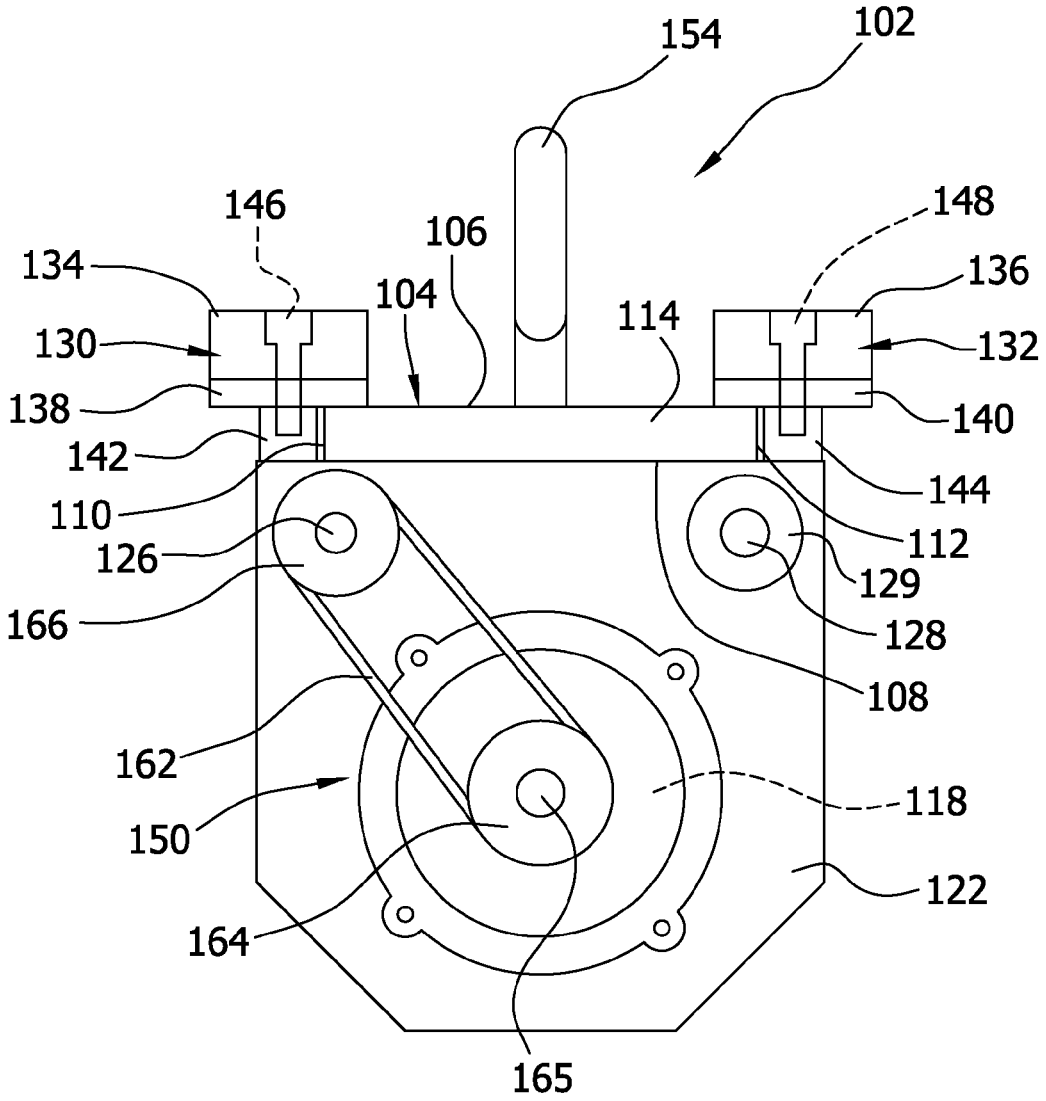
FIG. 3 is a front elevation of the removable plank unit.
Figure 4:
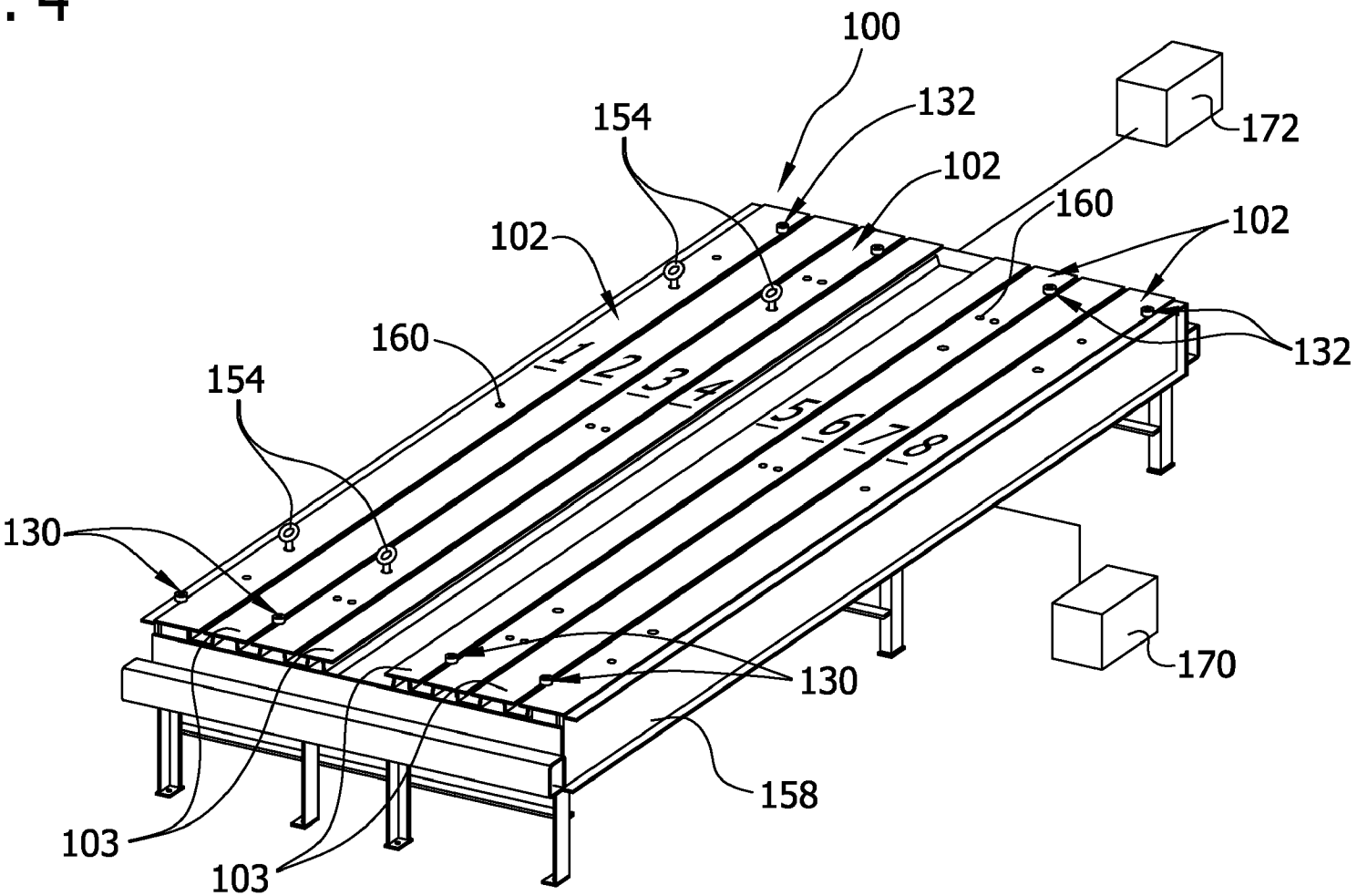
FIG. 4 is a perspective of a truss assembly jig setting table including a plurality of the plank units of FIG. 1.
Figure 5:
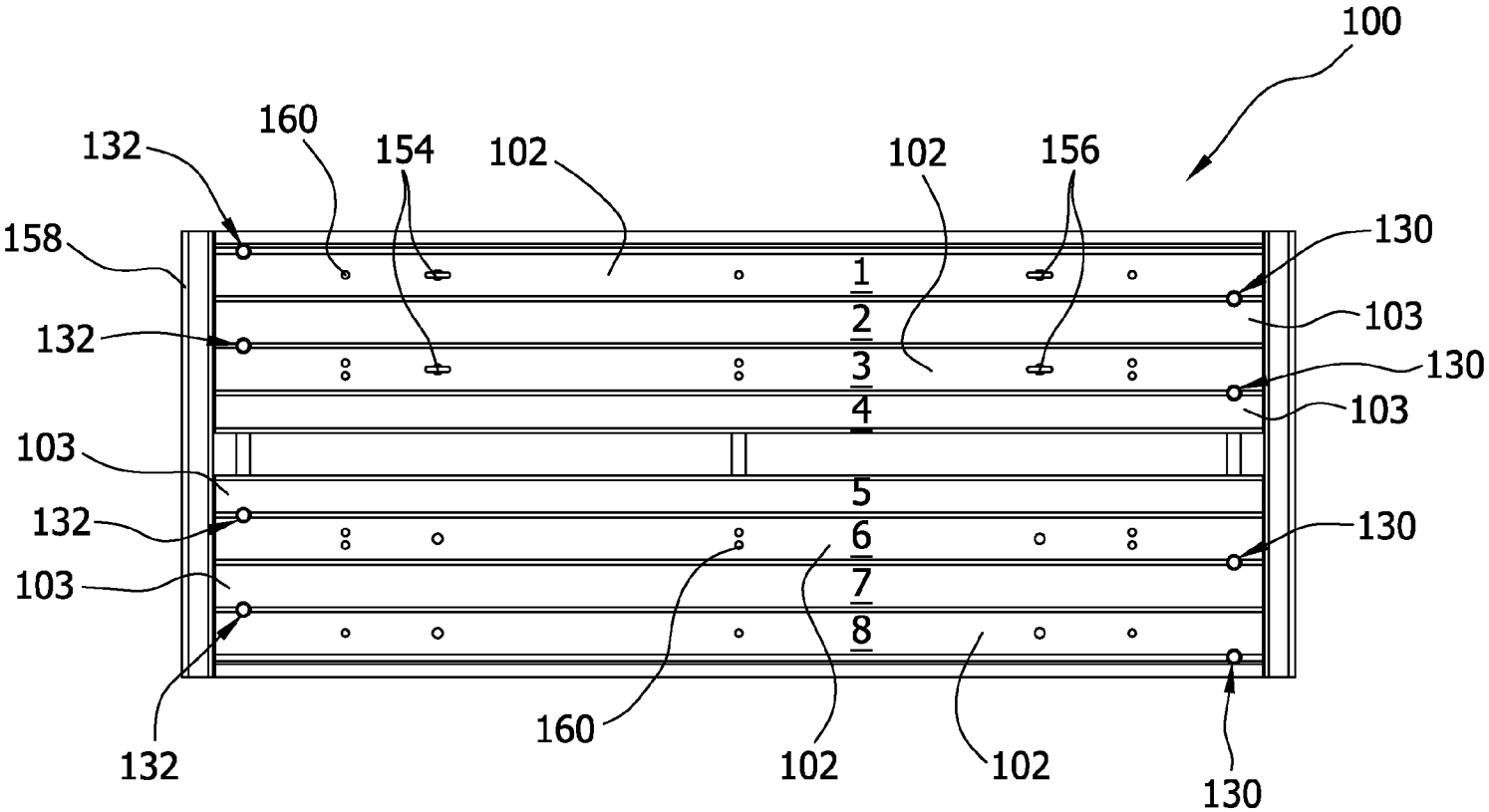
FIG. 5 is a top plan of the truss assembly jig setting table.

Referring to FIGS. 1-3, there can be seen a removable plank unit, generally indicated at 102, of a truss assembly jig setting system according to an embodiment of the present invention. Removable plank unit includes a plank, generally indicated at 104, which comprises a top surface 106 and opposing bottom surface 108, opposite first 110 and second 112 side surfaces, and front (broadly, first) 114 and rear (broadly, second) 116 ends. Planks 104 are typically made of steel, but may be made of any other durable material. Removable plank unit 102 may further include first 154 and second 156 transport members (e.g., threaded eye bolts) attached to plank 104, which aid in installation and removal of the removable plank unit. Removable plank unit 102 may also include apertures 160 through plank 104 through which fasteners, such as bolts, may be inserted for attaching removable plank unit 102 to a truss jigging table 100 (FIGS. 4 and 5). Alternatively, nails, rods, or any other fastener may be used to secure the removable plank unit 102 to the table 100. Removable plank units 102 may have different widths and lengths as required for the particular table into which the segments are to be installed.

A first motor plate 122 is affixed to bottom surface 108 of plank 104 near first end 114, and a first drive motor 118 is affixed to the first motor plate 122. Similarly, a second motor plate 124 with a second drive motor 120 affixed thereto is secured to the bottom surface 108 of the plank 104 near the second end 116. Alternatively, both drive motors 118, 120 may be attached to one of the motor plates near either end of the plank 104.

First and second threaded rods 128, 126 extend between the first and second motor plates 122, 124 and are rotatably secured thereto by bearings (only bearing 129 associated with the rod 128 is shown in the drawings). The bearings 129 allow the rods 126, 128 to rotate about their longitudinal axes, for reasons explained below. Preferably, the rods 126, 128 are arranged in a side by side configuration. In the alternative, the rods 126, 128 may be arranged vertically adjacent to one another. At least a portion of each rod 126, 128 is preferably disposed directly beneath the bottom surface 108 of plank 104, although the rods may be located entirely laterally of the plank without departing from the scope of the invention.

A pulley system, generally indicated at 150, 152, connects each drive motor 118, 120 to one of the rods 126, 128 in order to rotate the rods about their longitudinal axes. Each pulley system 150, 152 comprises an endless belt 162 wrapped around a first pulley 164 mounted on an output shaft 165 of the motor 118, 120, and a second pulley 166 mounted on the rod 126, 128.

A pair of puck assemblies, generally indicated at 130, 132, are operatively engaged with the rods 126, 128 so that rotation of the rods produces translational movement of the puck assemblies along the lengths of the rods. Each puck assembly 130, 132 comprises a puck 134, 136 secured to a puck carriage 142, 144 by a bolt 146, 148 extending through bores in the puck and puck carriage. Each puck carriage 142, 144 has a threaded aperture (not shown) through which the respective rod 126, 128 is inserted to mount the carriage on the rod. The thread of each aperture is a suitable complementary thread for transferring power, such as, for example, an acme or square thread. Accordingly, rotational movement of the rods 126, 128 produces translational movement of the respective puck carriages 142, 144 and the pucks 134, 136 along the length of the rod. Each puck 134, 136 sits atop respective puck carriage 142, 144 with an optional washer 138, 140 therebetween. The pucks 134, 136 are preferably made of steel, but may be made of any other durable material. The bottommost surface of each puck/washer combination is a wear surface that rests on top surface 106 of plank 104. The washer 138, 140 protects the puck 134, 136 from wear and can be replaced without replacing the puck. The washer 138, 140 can be made of a suitable low friction material such as a nylon. It is to be understood that the puck assemblies may have other configurations within the scope of the present invention.

The location of puck assemblies 130, 132 in different slots on adjacent sides of the plank 104 of each removable plank unit 102, rather than within a single slot through the plank, allows for a more versatile and flexible puck setting system. Two pucks 134, 136 can thus typically be positioned along the length of even the shortest truss member. This also makes it easier to position more pucks 134, 136 nearer to either end of the table. In addition, because one puck 134, 136 is located on each side of each plank 102, the actual distance between pucks on adjacent planks is less than the "on-center" distance (the distance from the center of one plank to the center of a next plank) between planks.

In operation, activation of drive motor 118 in a first rotational direction produces rotation of rod 126 in the first rotational direction due to pulley system 150. Rotation of rod 126 in first direction causes translational motion of puck assembly 130 in a first translational direction along rod 126. For example, the first rotational direction may be clockwise, and the first translational direction may be away from the associated mounting plate 122. Rotation of drive motor 118 in the opposite direction accordingly causes translational motion of puck assembly 130 in an opposite, second translational direction along the rod 126. For example, the second rotational direction may be counterclockwise, and the second translational direction may be toward the associated mounting plate 122. Movement of puck assembly 132 is carried out in a like manner. Because each puck assembly 130, 132 is associated with a separate drive motor 118, 120, movement of puck assemblies 130, 132 may be carried out independent of one another. One of skill in the art will recognize that rotation of the drive motor may be translated to linear movement of the puck assembly by various other means, such as, for example, by a gear system.

It will be appreciated that removable plank unit 102 carries a completely self-contained puck movement system. This provides substantial flexibility to the table manufacturer in locating pucks 134, 136 on a new table, so that customized tables can be made at reasonable cost. Moreover, this allows removable plank units 102 to be retrofit to existing truss assembly jigging tables to create an automated truss assembly jig setting system without the expense of constructing or purchasing a completely new table. Removable plank unit 102 need only be connected to a power system and a computer control system to be suitable for automated puck positioning. It is understood that it is also advantageous to manufacture an original jigging table including the removable board segments 102.

Referring now to FIGS. 4 and 5 there can be seen a truss assembly jigging table 100 that has been retrofit with removable plank units 102 to create an automated truss assembly jig setting table. As can be seen, truss assembly table 100 comprises a table frame 158 fitted with a plurality of plank units in numbered positions 1-8. Note that tables with greater or fewer plank units may also be placed according to the present invention. Originally, table 100 would have included traditional plank units 103 in all positions. To retrofit the table for an automated truss assembly jig setting system, planks 103 in positions 1, 3, 6, and 8 were removed and removable plank units 102 were inserted. This creates a table having one puck assembly 130 or 132 between each pair of adjacent plank units. This allows each puck assembly 130, 132 the ability to be positioned anywhere along the length of the table 100. It will be understood that the table 100 can be originally manufactured in the configuration illustrated in FIGS. 4 and 5. Alternatively, removable plank units 102 may be inserted into any other combination of positions 1-8 as assembly of a particular truss design may dictate. For example, removable plank units 102 may be inserted into all of the positions 1-8, in which case each adjacent pair of plank units would have two puck assemblies there between. Although depicted as being retrofitted across the width of a table, removable segments 102 can be configured to be installed lengthwise or at an angle across a table.

Figure 6:
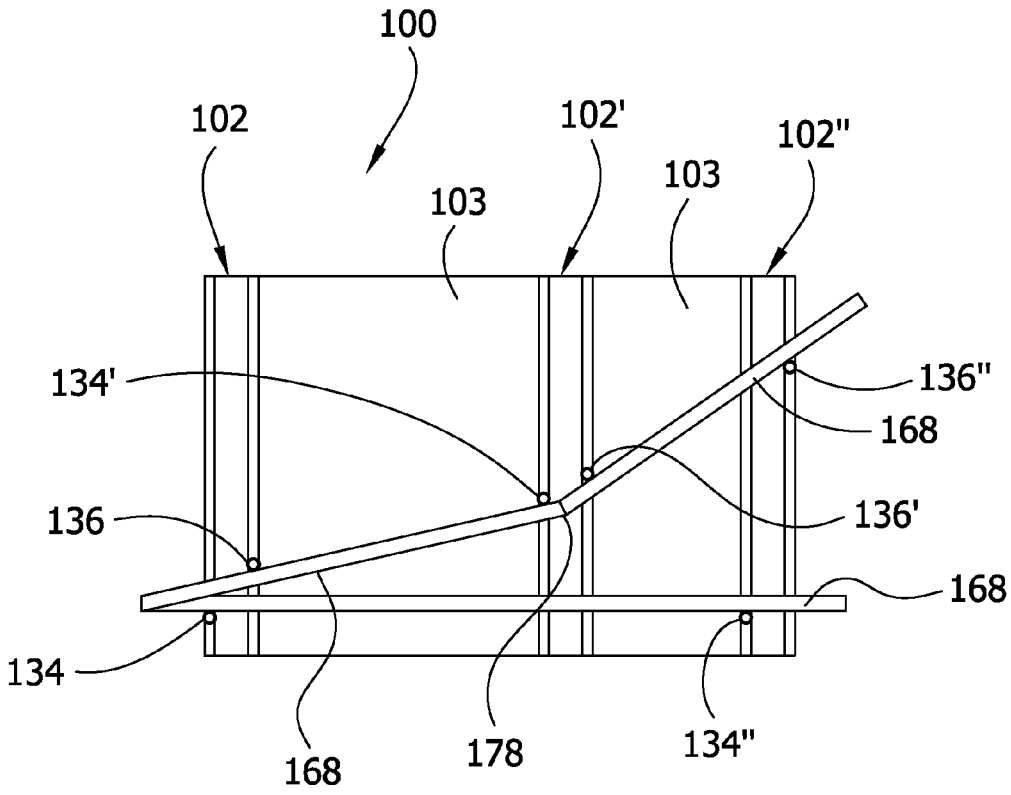
FIG. 6 is a partial top plan of the truss assembly jig setting table with truss members arranged thereon.

Because the puck assemblies 130, 132 of the plank unit 102 are on opposite sides of the board and are independent of each other, both puck assemblies of a single board may engage either the top of bottom chord members 168 of the truss. For example, as seen in FIG. 6, the puck 134' of the of the middle plank 102' is disposed to the left of a pitch break 178 in the upper truss chord and the other puck 136' is disposed to the right of the same pitch break. Because the width of the plank unit 102 is preferably between about 6 in (15 cm) and about 10 in (25 cm), the pucks 134', 132' engage the truss chord members adjacent to the pitch break 178 to improve accuracy of manufacture of the truss. Further, the pucks 134, 136 may be positioned within the interior of the perimeter of the truss so that the pucks engage interior surfaces of the chord members, as seen by puck 136" of plank unit 102" in FIG. 6. It is understood that one of the pucks 134, 136 of the plank unit 102 may be positioned within the interior of the truss, both of the pucks, or neither of the pucks, within the scope of the present invention.

It is understood that the distance between removable plank units 102 may be varied. In addition, the width of the removable plank units 102 themselves can vary. This allows puck assemblies 130, 132 to be optimally placed depending on the locations of the particular truss members 168 of a given truss. This also allows removable plank units 102 to be fitted to a greater variety of existing truss tables, as a particular table layout is not required in order to retrofit removable plank units 102.

Referring to FIG. 4, truss assembly table 100 need only be connected to a power system 170 (connection being shown schematically by solid lines) and a computer control system 172 (connection being shown schematically by dashed lines) having software capable of positioning the pucks to create an automated truss assembly jig setting table. Software programs are well known and generally available that can calculate the positions of the pucks on the table and activate the drive motors to move the pucks to their proper positions. Typically, the shape of a truss is known and its details are fed into the control system, which then activates the drive motors and moves the pucks into their desired positions.

Figure 7:
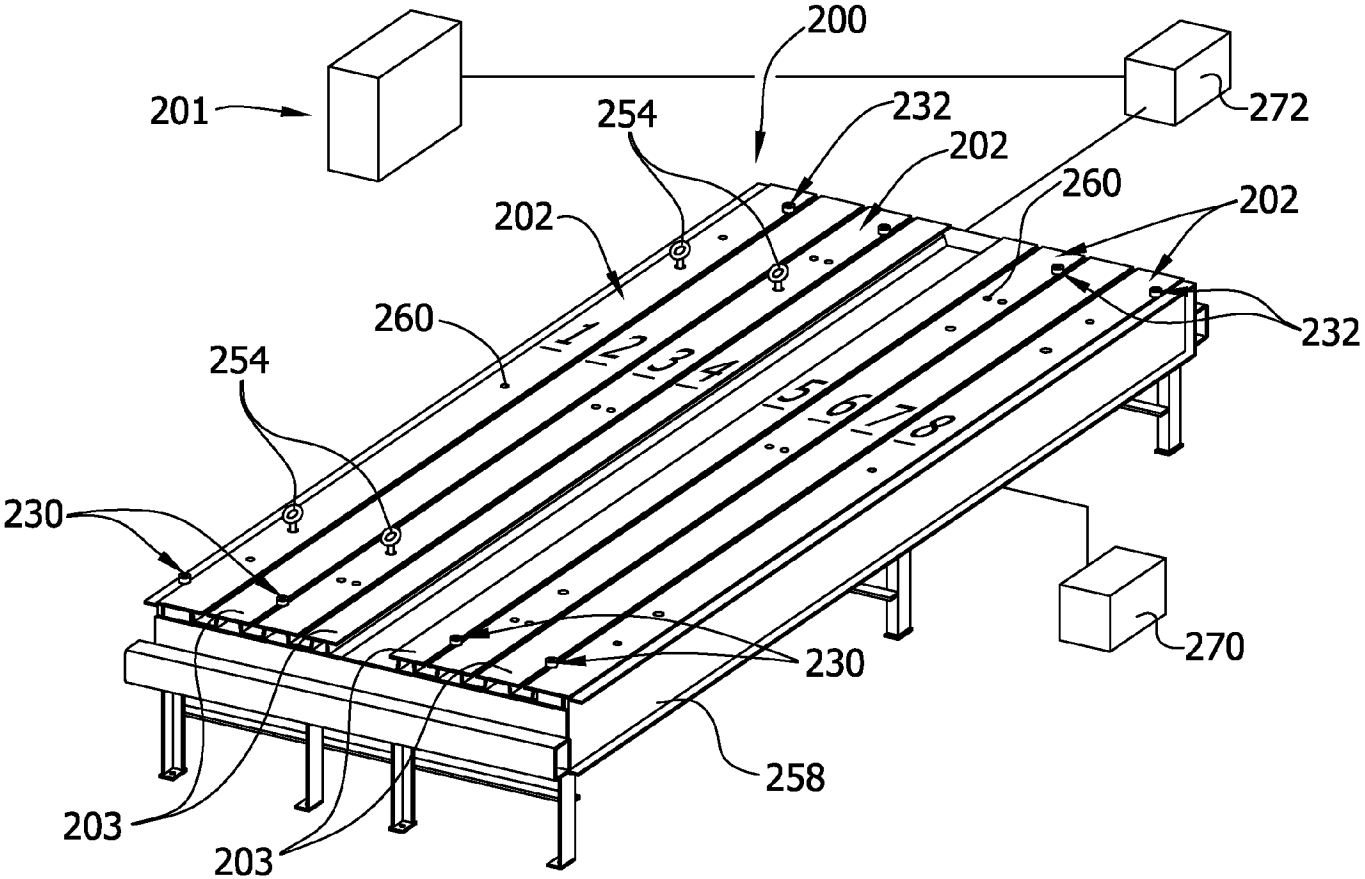
FIG. 7 is a perspective of another embodiment of a truss assembly jig setting table.
Figure 8:
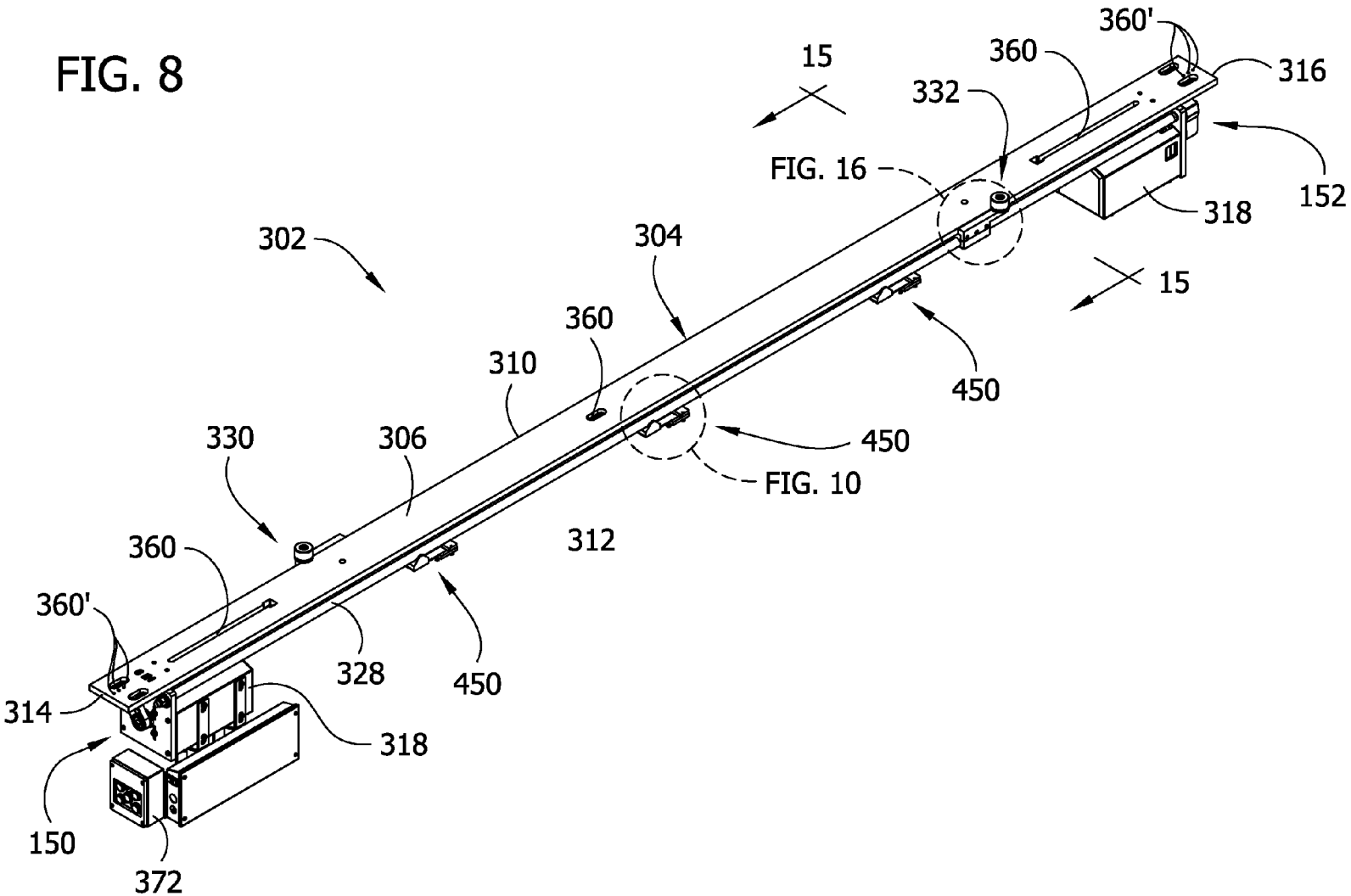
FIG. 8 is a perspective of another embodiment of removable plank unit.

Referring to FIG. 7, another embodiment of a truss assembly table is generally indicated at 200. This table is similar to the prior embodiment 100, and therefore, like components are indicated by corresponding reference numerals plus 100. The difference between this table 200 and the prior embodiment 100 is that the present table has a laser projection system, generally indicated at 201, that projects a laser image of a desired truss in actual shape and size on the work surface, which ensures greater accuracy in truss assembly (not shown). Some fragment(s) of the truss or component part(s) may be projected onto the upper surface of the table without departing from the scope of the present invention. The laser projection system 201 may be interfaced with the same computer control system 272 as the removable plank units 202, or may be interfaced with a different controller. The laser projection system 201 may also be electrically connected to the same power system 270 as the plank units 202. Known laser truss assembly systems are disclosed in U.S. Pat. No. 6,317,980 (owned by the owner of this application), the entirety of which is herein incorporated by reference for providing complete disclosure.

Referring still to FIG. 7, the removable plank units 202 of the type described above are advantageously placed in the truss assembly table 200. Placing removable plank units 202 in the table 200 creates a table that utilizes both laser projection and automated puck positioning. Use of an automated system dramatically increases the speed and efficiency of the system relative to standard laser projection systems. In addition, placing the automated system in a laser projection system, rather than a standard table, provides a check on the automated system such that an operator can easily tell whether it is functioning accurately and reliably.

Figure 9:
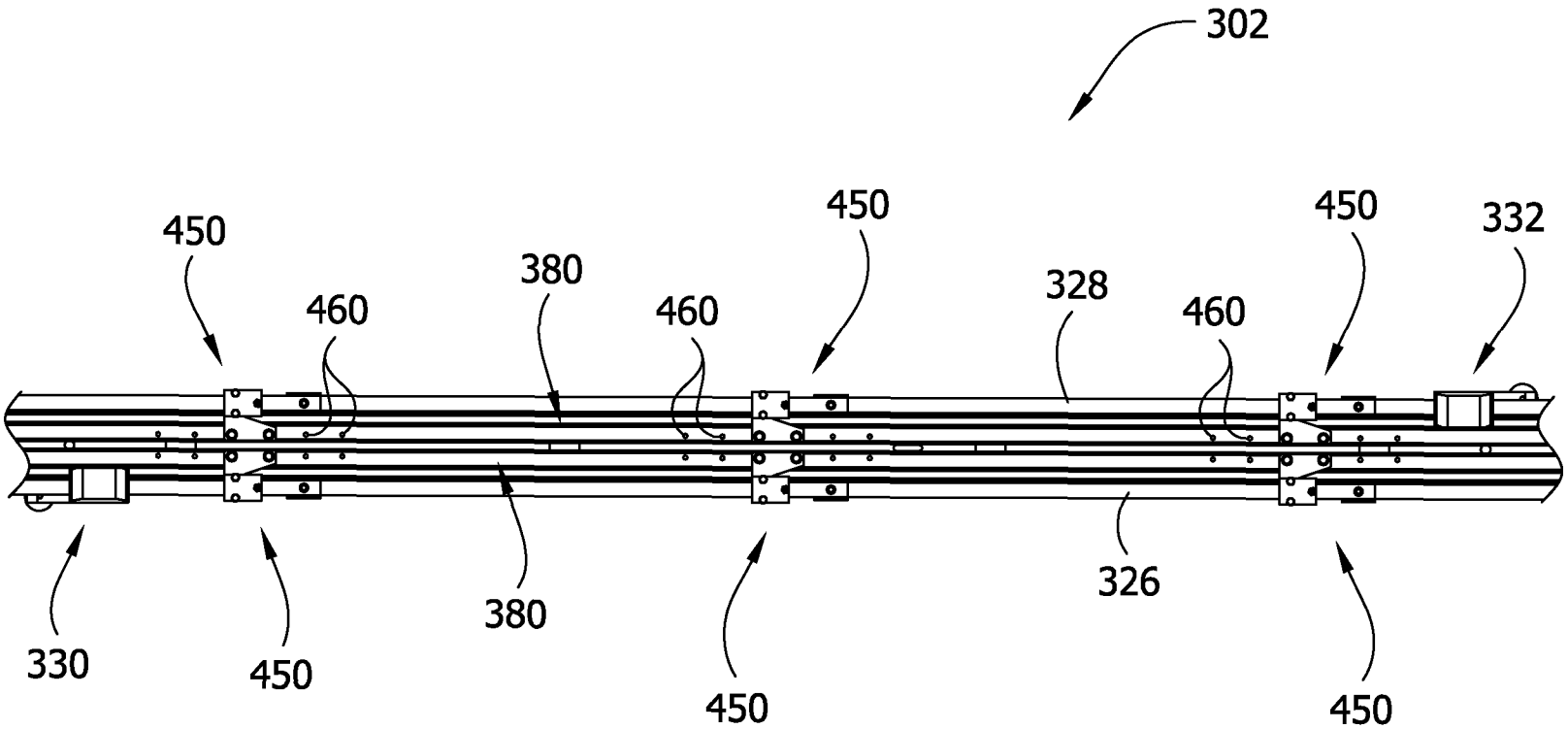
FIG. 9 is a bottom plan view of the plank unit.
Figure 10:
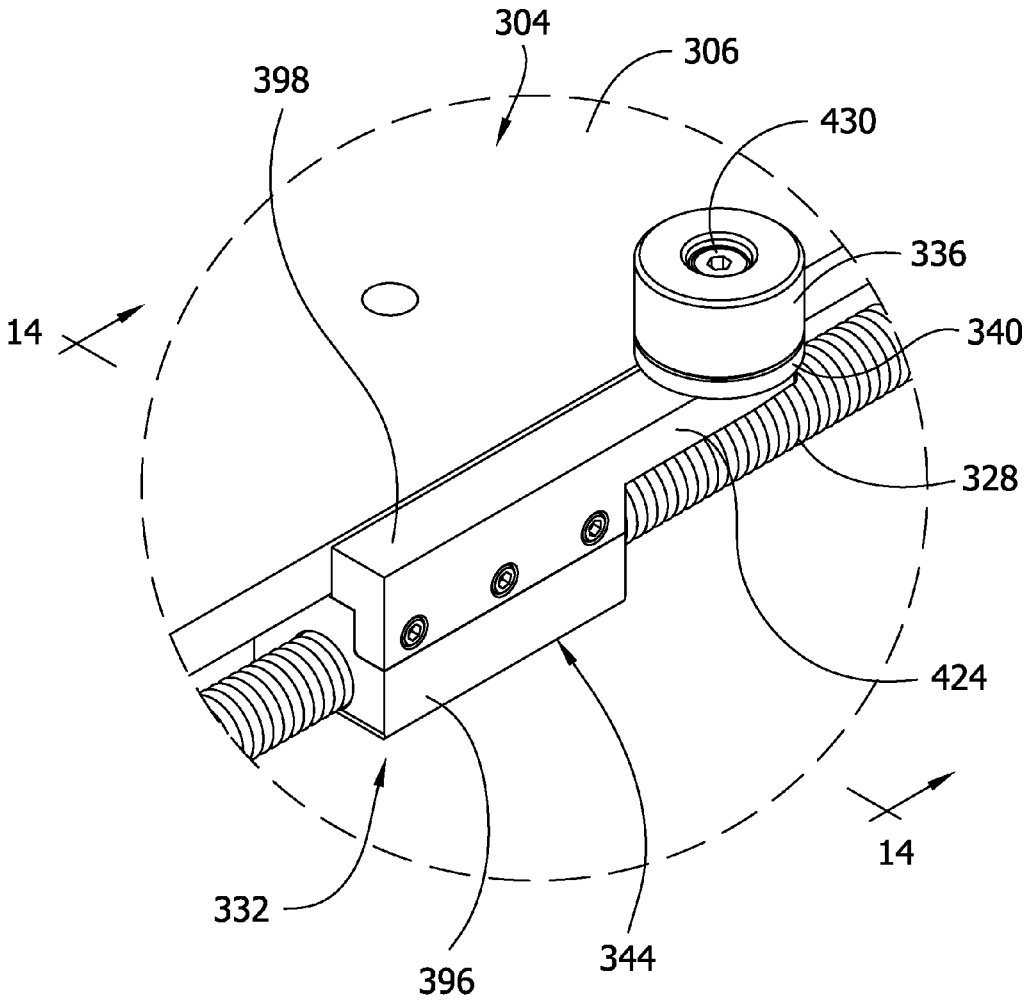
FIG. 10 is an enlarged fragmentary perspective taken as indicated in FIG. 8 showing a puck assembly.
Figure 11:
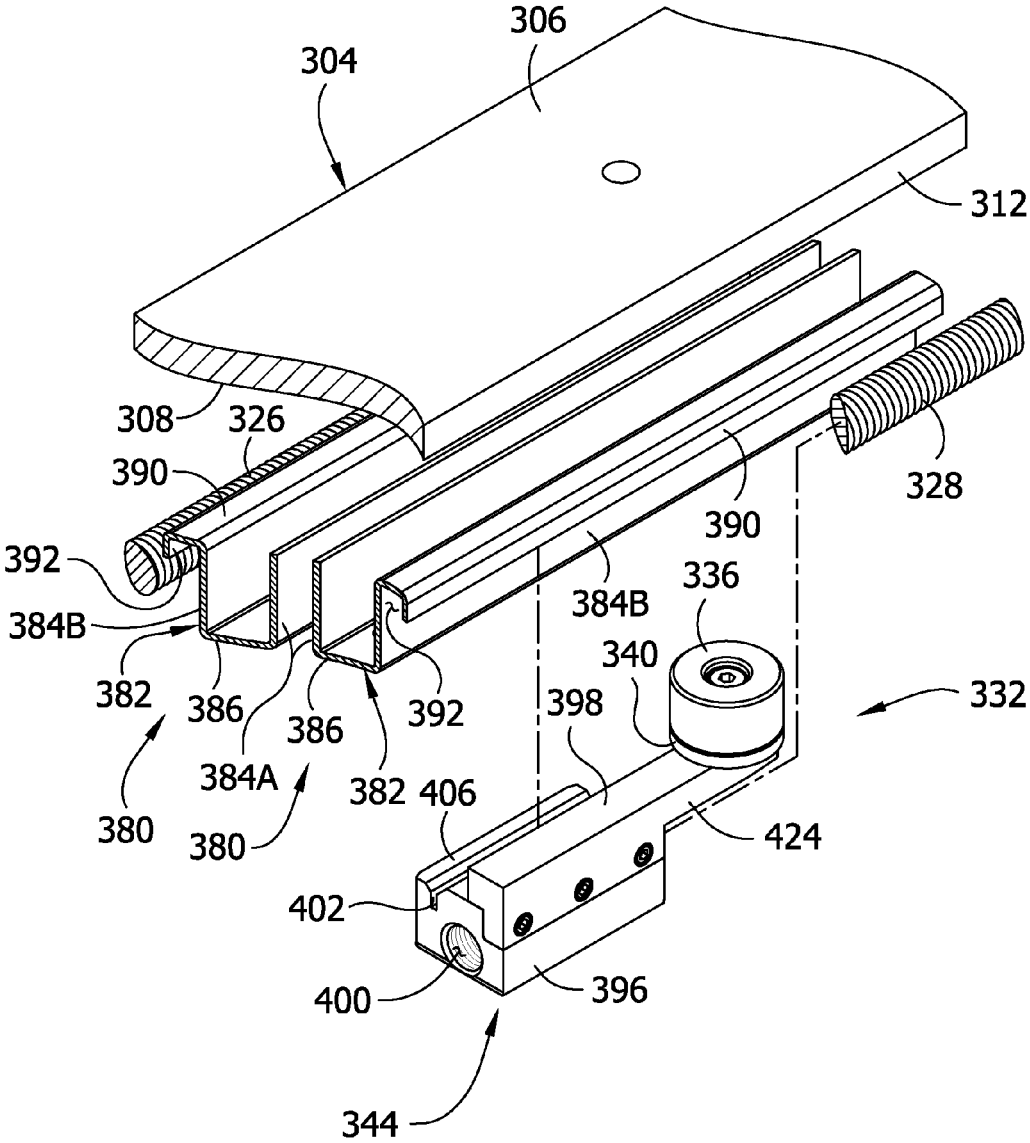
FIG. 11 is an exploded view of FIG. 10.
Figure 12:
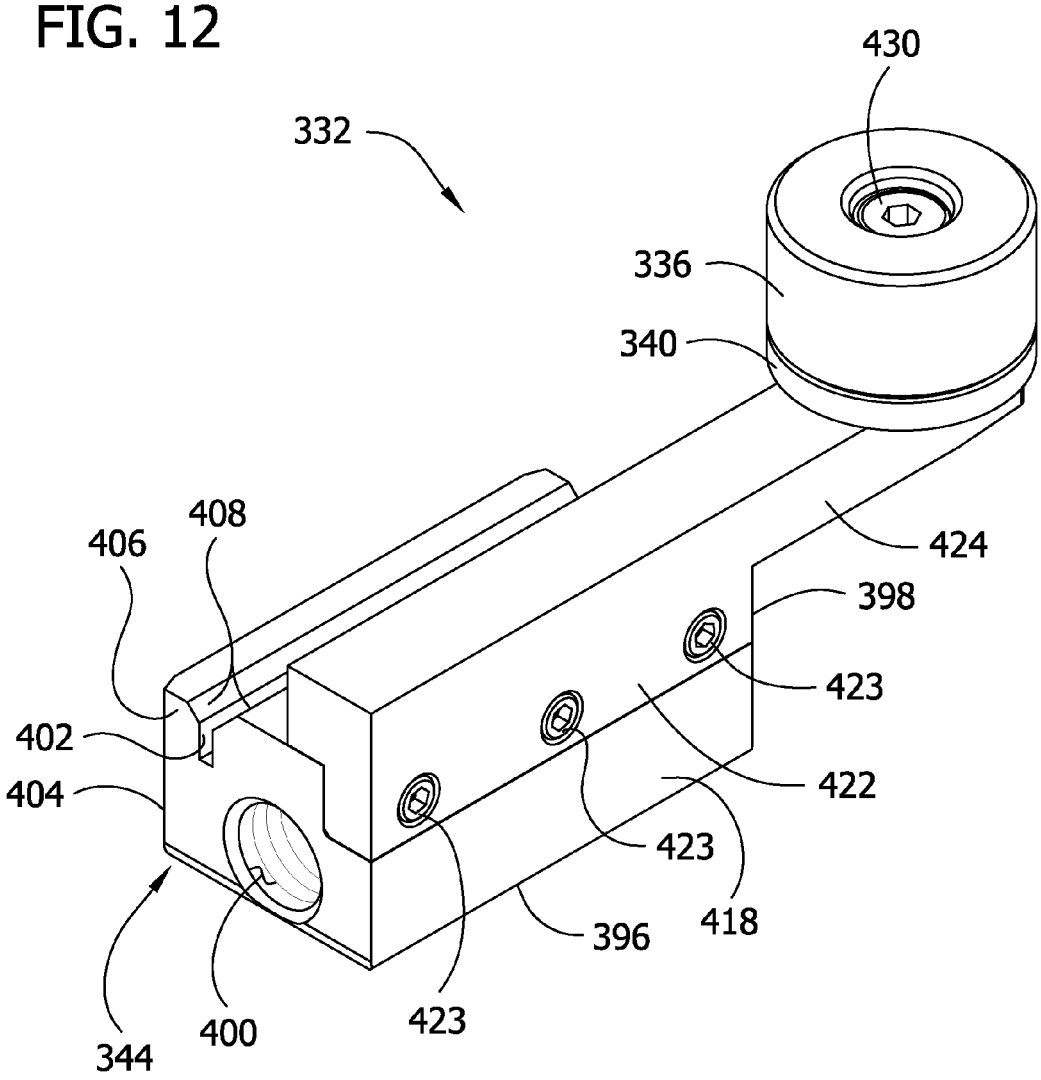
FIG. 12 is an enlarged perspective of the puck assembly of FIG. 11.

Referring now to FIGS. 8-21, another embodiment of a removable plank unit is generally indicated at 302. This embodiment is similar to the plank unit 102, and therefore, like components are indicated by corresponding reference numerals, plus 200. Referring to FIGS. 9, 11 and 14, a pair of laterally spaced apart elongate struts, generally indicated at 380, extend along the length of the plank 304 and are secured to the bottom surface 308 of the plank to provide structural support against bending when large loads are applied to the upper surface 306 during assembly of a truss. As seen best in FIGS. 11 and 14, each strut 380 includes a generally U-shaped body, generally indicated at 382, having spaced apart inner and outer legs 384A, 384B, respectively, extending downward from the bottom surface 308 of the plank 304 and a web member 382 extending between and connecting lower ends of the legs. An L-shaped arm 390 extends laterally outward from an upper end of each outer leg 384B of the U-shaped bodies 380. For purposes explained below, the outer leg of 384B of each base 382 and the respective L-shaped arm 390 together constitute a track defining an inverted channel 392 for receiving a portion of a corresponding puck assembly.

The plank 304 includes apertures 360 for attachment of the plank unit 302 to the table. Three openings 360' at each longitudinal end of the plank are roll pin openings for receiving roll pins (not shown) through the plank into connection with a mounting plate of the table to fix the plank unit in position after it has been aligned and calibrated. An opening in the mounting plate of the table (not shown) is drilled only after the alignment and calibration is completed. If it later becomes necessary to remove the plank unit 302 for repair (for example), the plank unit 302 can be removed and then replaced by inserting roll pins through the same openings 360' previously drilled in the table mounting plate. This permits the plank unit 302 to be reinstalled without requiring recalibration.

Referring to FIGS. 10-15, the puck assemblies 330, 332 of the present embodiment are substantially identical in structure, and therefore, only puck assembly will be described in detail. The puck carriage 344 (indicated generally) of the puck assembly 332 includes a base 396 having a threaded bore 400 for receiving and threadably engaging the rod 328 (FIG. 10) and a mount 398 on which the puck 336 and the washer 340 are mounted. In one example, the base 396 is formed from an oil impregnated nylon material, such as NYLATRON, although other materials may be used. The mount 398 may be formed from aluminum, although other materials may be used.

A longitudinal guide slot 402 is formed in an upper portion of the base 396 adjacent to an inner side 404 of the base. Referring to FIG. 14, the guide slot 402 receives the free end of the L-shaped arm 390 of the corresponding strut 380 so that an upper, longitudinal portion 406 of the base 396 is received in the inverted channel 392, as described briefly above. An upper portion 408 (FIGS. 14 and 12) of the slot 402 tapers downward to facilitate insertion of the L-shaped arm 390 into the slot. As seen best in FIG. 14, the puck assembly 344 is further guided and its rotation restricted by virtue of a lower portion 412 of the inner side wall 404 of the base 396 the outer leg 384B of the strut 380. During use, the track defined by the L-shaped arm 390 and the base 382 of the strut 380 guides the puck assembly 344 along the length of the rod 328 and prevents rotation of the base 396 with the rod to thereby ensure that puck assembly moves linearly along the rod as the rod rotates. Other ways of guiding and preventing rotation of the puck assemblies is within the scope of the invention.

Figure 13:
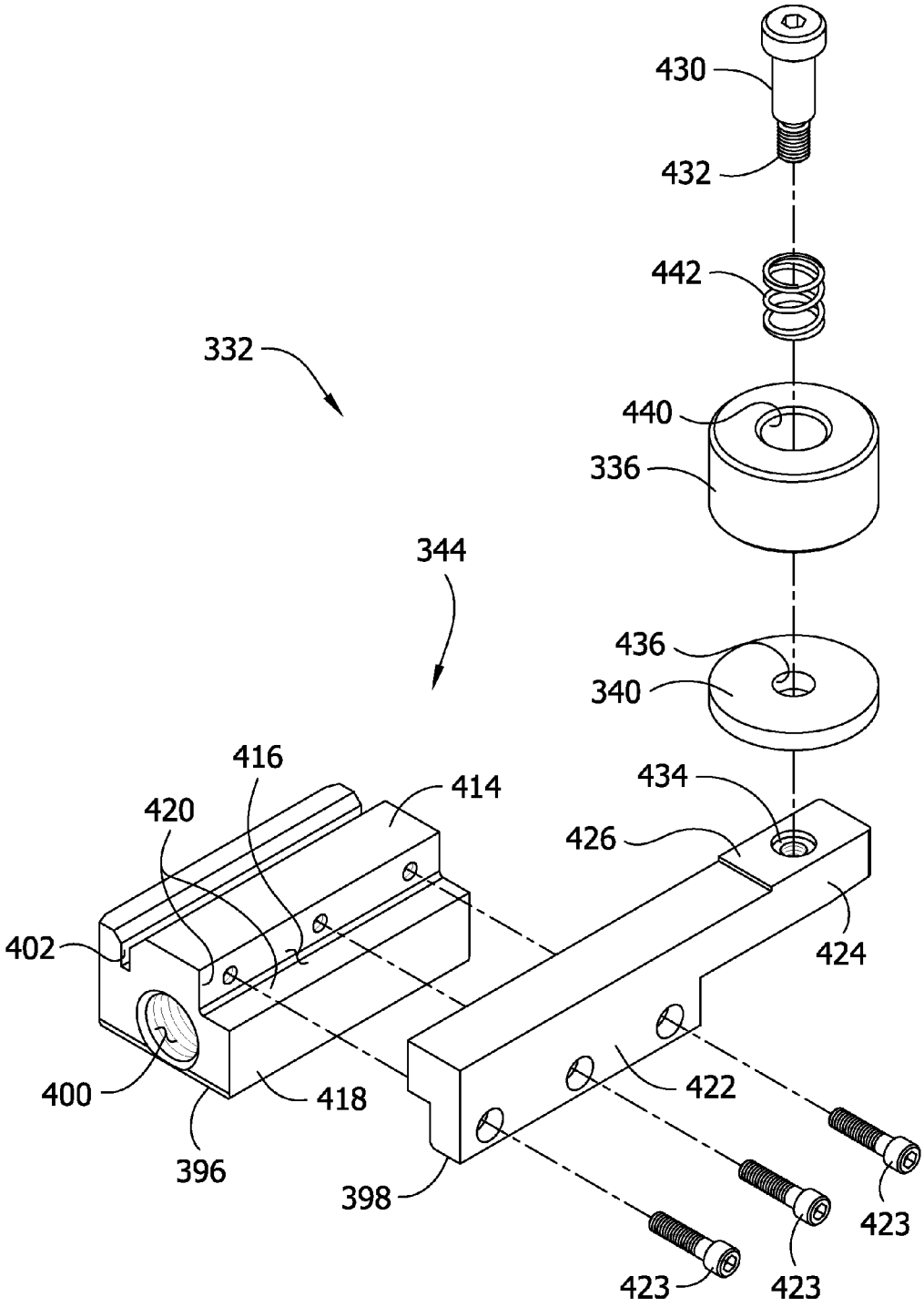
FIG. 13 is an exploded perspective of the puck assembly of FIG. 12.
Figure 14:
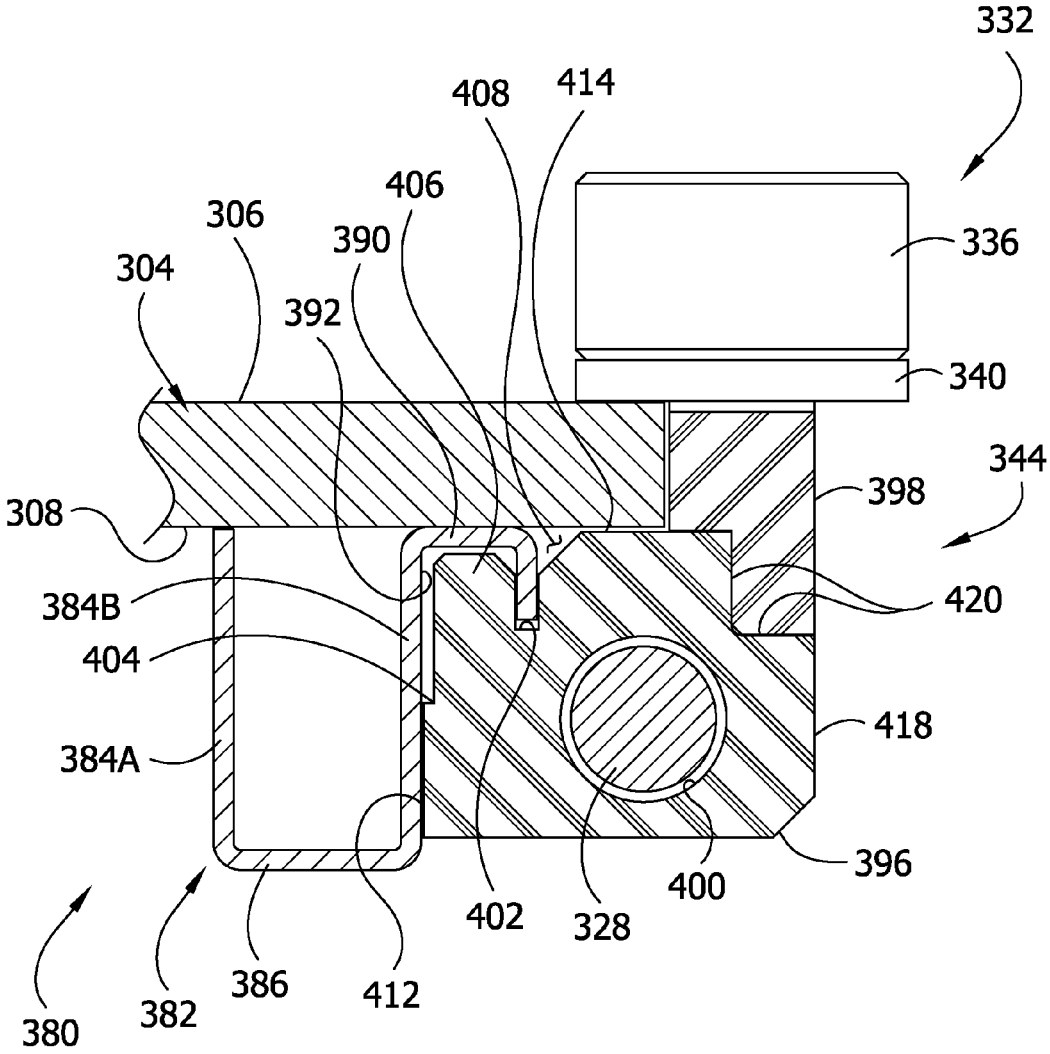
FIG. 14 is a section taken in the plane containing the line 14-14 in FIG. 10.

Referring to FIG. 13, the mount 398 of the puck assembly 344 is secured within a notch 416 extending through an outer side wall 418 and the upper surface 414 of the base 396. As seen best in FIG. 14, a section of the mount 398 engaging the base 396 has a cross-section that is generally an inverted L-shape so that the mount rests substantially flush against the upper surface 414 of the base and surfaces 420 defining the notch 416 and so that an outer side surface 422 of the mount extends up from and is substantially coplanar with the outer wall 418 of the base. As seen best in FIG. 13, the mount 398 is secured to the base 396 by three fasteners 423 extending through the outer side surface of the mount 422 and threaded into one of the surfaces 420 defining the notch 416. Referring still to FIG. 13, an elongate finger 424 of the mount 398 extends rearward from an upper portion of the L-shaped section. A top surface 426 of the finger at a free end margin where the puck 336 and the washer 340 are mounted is generally coplanar with the top surface 306 of the plank 304. Other ways of securing the mount to the base and/or making the carriage assembly are within the scope of the invention.

Figure 15:
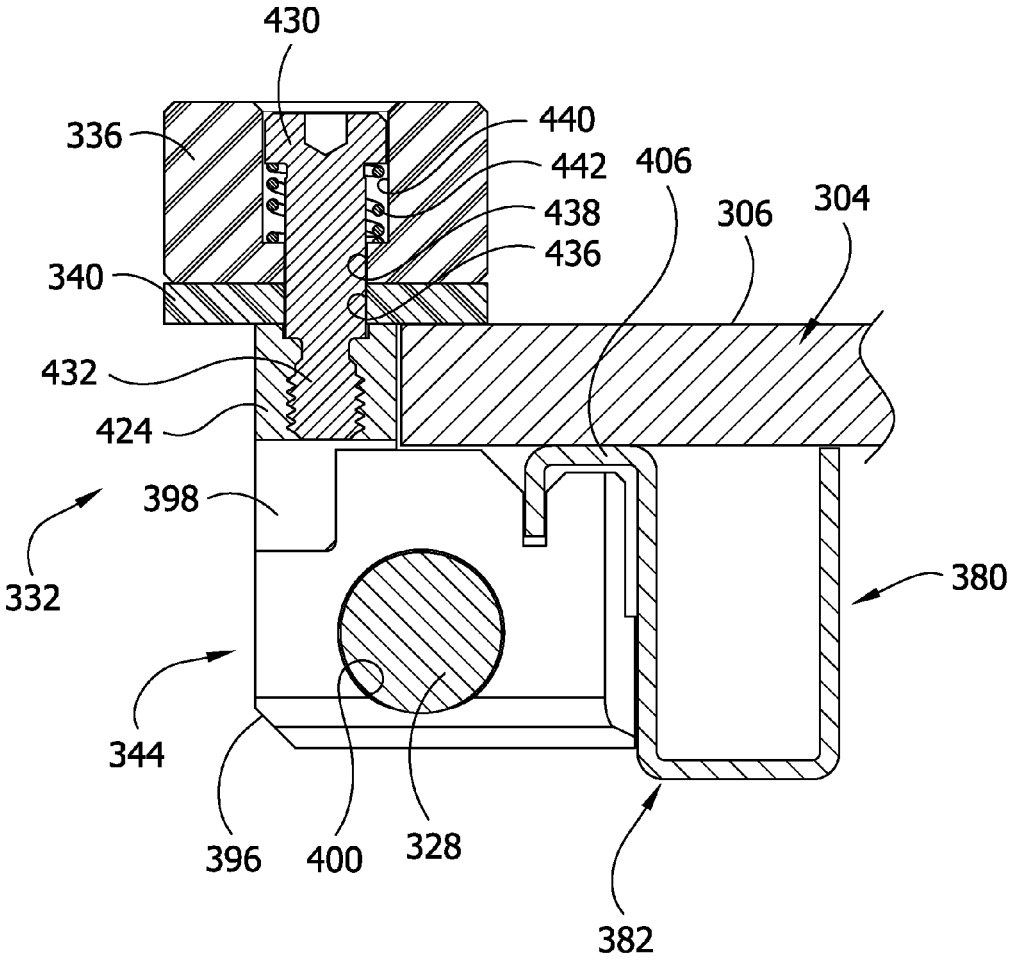
FIG. 15 is a section taken in the plane containing the line 15-15 in FIG. 8.

Referring now to FIGS. 13 and 15, a shoulder bolt 430 secures the puck 336 and the washer 340 to the finger 424 of the mount 398. A threaded, free end margin 432 of the shank of the bolt 430 is threaded into a blind bore 434 of the finger 424 so that the remaining non-threaded portion of the shank extends upward through bores 436, 438 in the washer 340 and the puck 336 and into a counter-bore 440 in the puck. A compression spring 442 disposed around the non-threaded portion of the shank of the bolt 430 is captive within the counter-bore 440 of the puck 336 by a bottom surface defining the counter-bore and the head of the bolt. The spring 442 biases the puck 336 and the washer 340 downward in contact with the top surface 306 of the plank 304 and allows the puck and the washer to move upward and downward along the axis of the bolt 430 as the puck is driven linearly along the length of the plank. In this way, the puck assembly 332 may be used with a plank having somewhat non-linear upper surface that slopes along its length because the vertical position of the puck compensates for any irregular, non-linear portions of the top surface on which it is riding. Other ways of varying the vertical position of the puck as it moves along the plank to compensate for irregularities of the plank are within the scope of the present invention.

Referring back to FIGS. 8 and 9, a plurality of rod-supporting assemblies, generally indicated at 450, extend laterally outward from each of the struts 380 below the plank 304 and engage the rods 328, 326. Corresponding generally aligned rod-supporting assemblies 450 support each rod 328, 326 to substantially prevent sagging or bowing of the rods due to gravity and to maintain the general linearity of the rod as the rod rotates about its axis. In the illustrated embodiment, three rod-supporting assemblies 450 are spaced equally apart along the length of each rod (the rod-supporting assemblies associated with the rod 326 are not visible in FIG. 8), although it is understood that the plank unit may have more or fewer rod-supporting assemblies within the scope of the invention.

The rod-supporting assemblies 450 are substantially identical, and therefore, only one rod-supporting assembly will be described in detail. Referring to FIGS. 16-23, the rod-supporting assembly 450 includes a base plate 452 having an inner end margin secured to the web 386 of the respective strut 380 and a saddle block, generally indicated at 454, cantilevered from an outer end margin of the base by a resiliently elastic bar 455. The bar 455 exerts an upward force on the block 454, which is transferred to the rod 328 to maintain the linearity of the rod. The rod-supporting assemblies 450, by way of the saddle block 454 and resiliently flexible cantilever bar 455, and the spring 442 of the resiliently movable pucks 334, 336 together act to dampen vibrations and noise of the system as the rods are rotated and the pucks are moving linearly along the rods.

Figure 18:
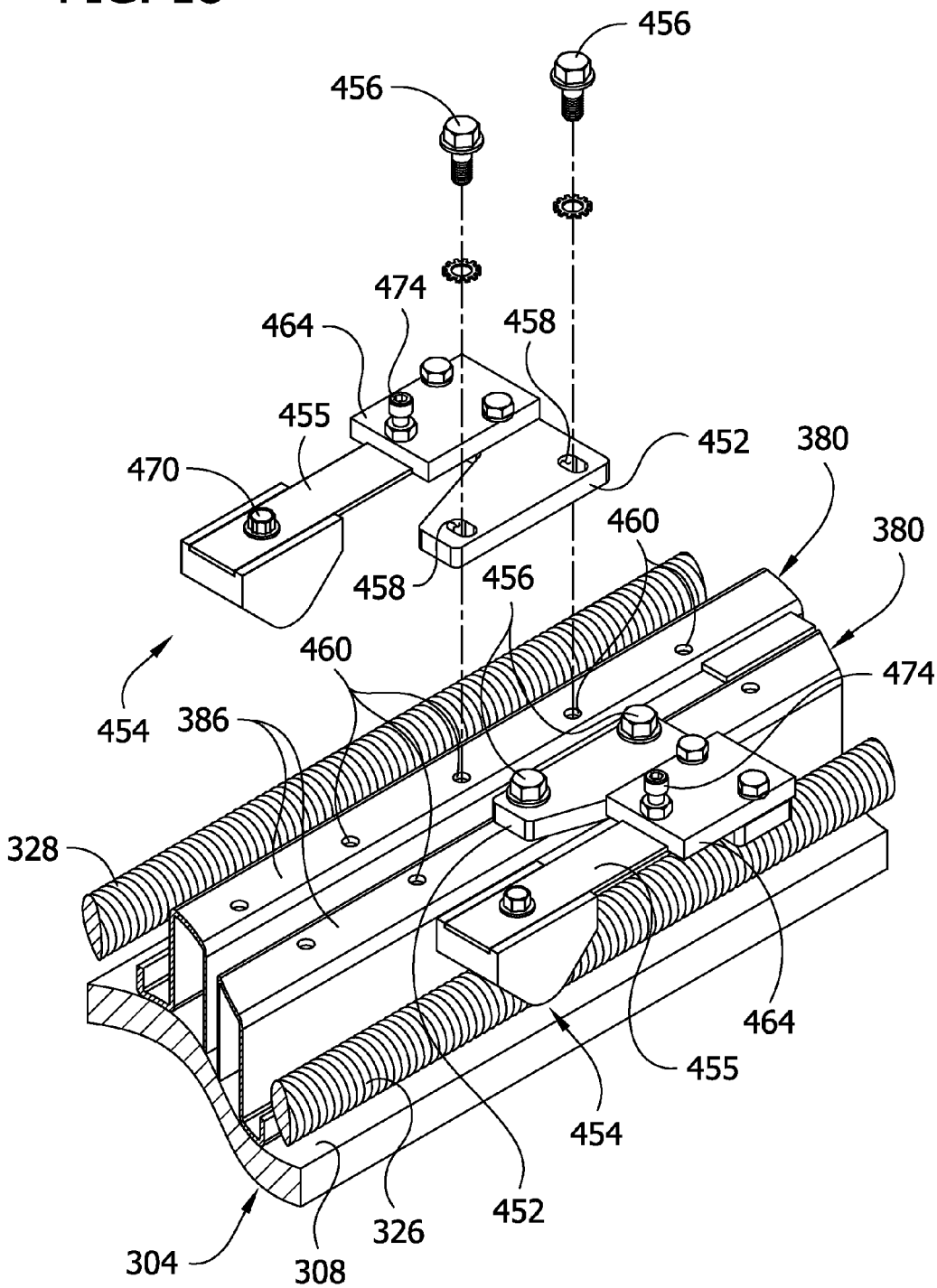
FIG. 18 is an enlarged fragmentary perspective; similar to FIG. 16, but showing the underside of the plank and with the rod-supporting assembly exploded from the plank unit.

As seen best in FIG. 18, the base plate 452 is secured to the strut 380 using threaded fasteners 456 (e.g., bolts) extending through openings 458 in the base plate and threaded into in bores 460 in the web 386. Referring still to FIG. 18, the web 386 has a plurality of such bores 460 spaced along the length of the strut 380 for securing the rod-supporting assemblies 450 at selective longitudinal positions.

Figure 16:
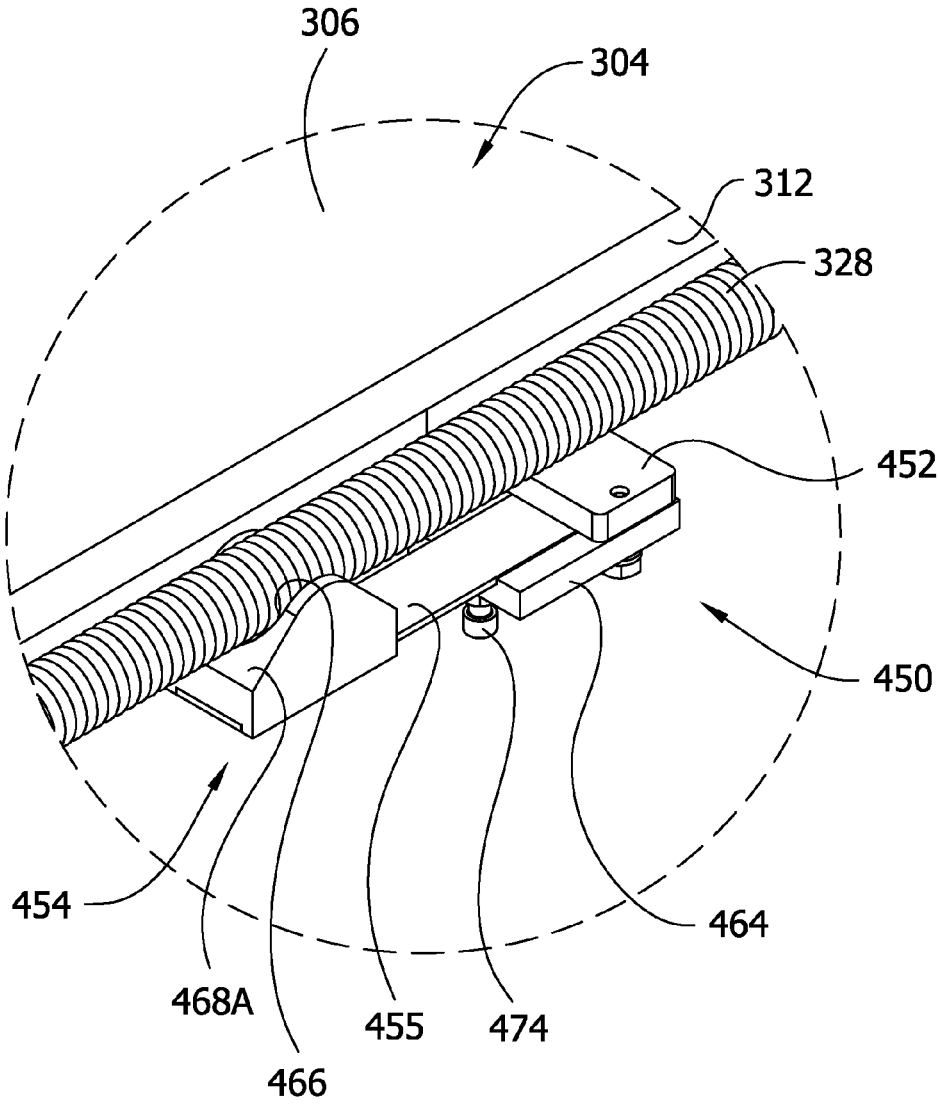
FIG. 16 is an enlarged fragmentary perspective taken as indicated in FIG. 8 showing a rod-supporting assembly.
Figure 17:
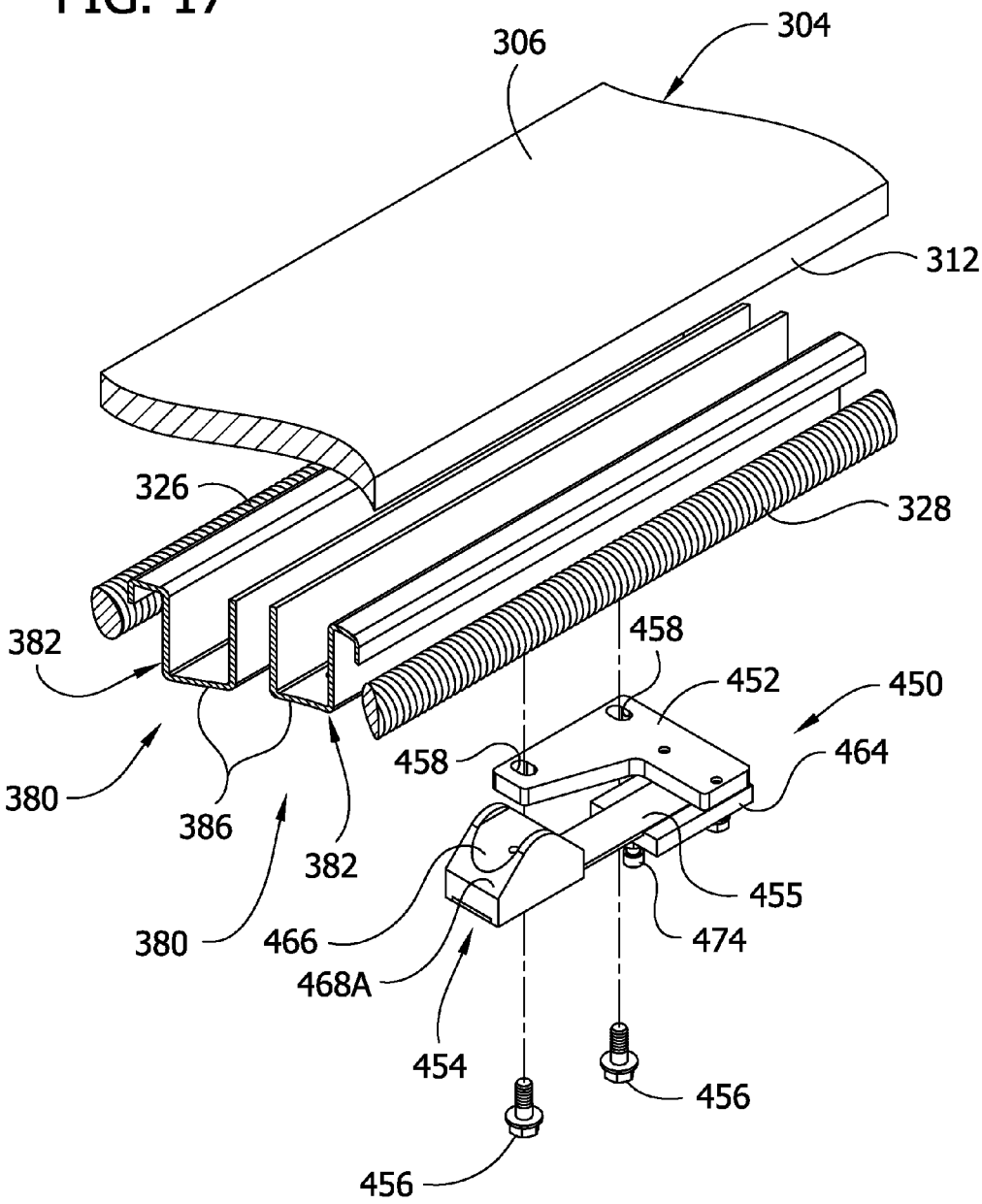
FIG. 17 is an exploded view of FIG. 16.
Figure 19:
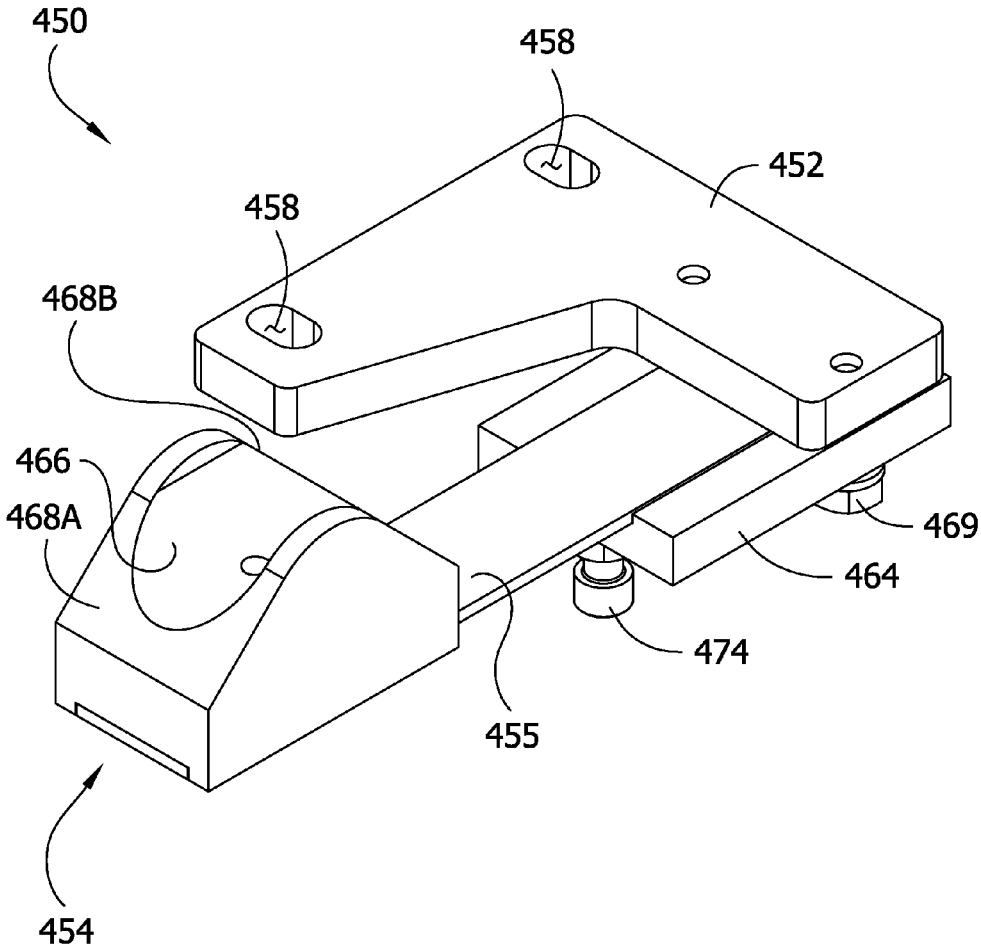
FIG. 19 is an enlarged perspective of the rod-supporting assembly.
Figure 20:
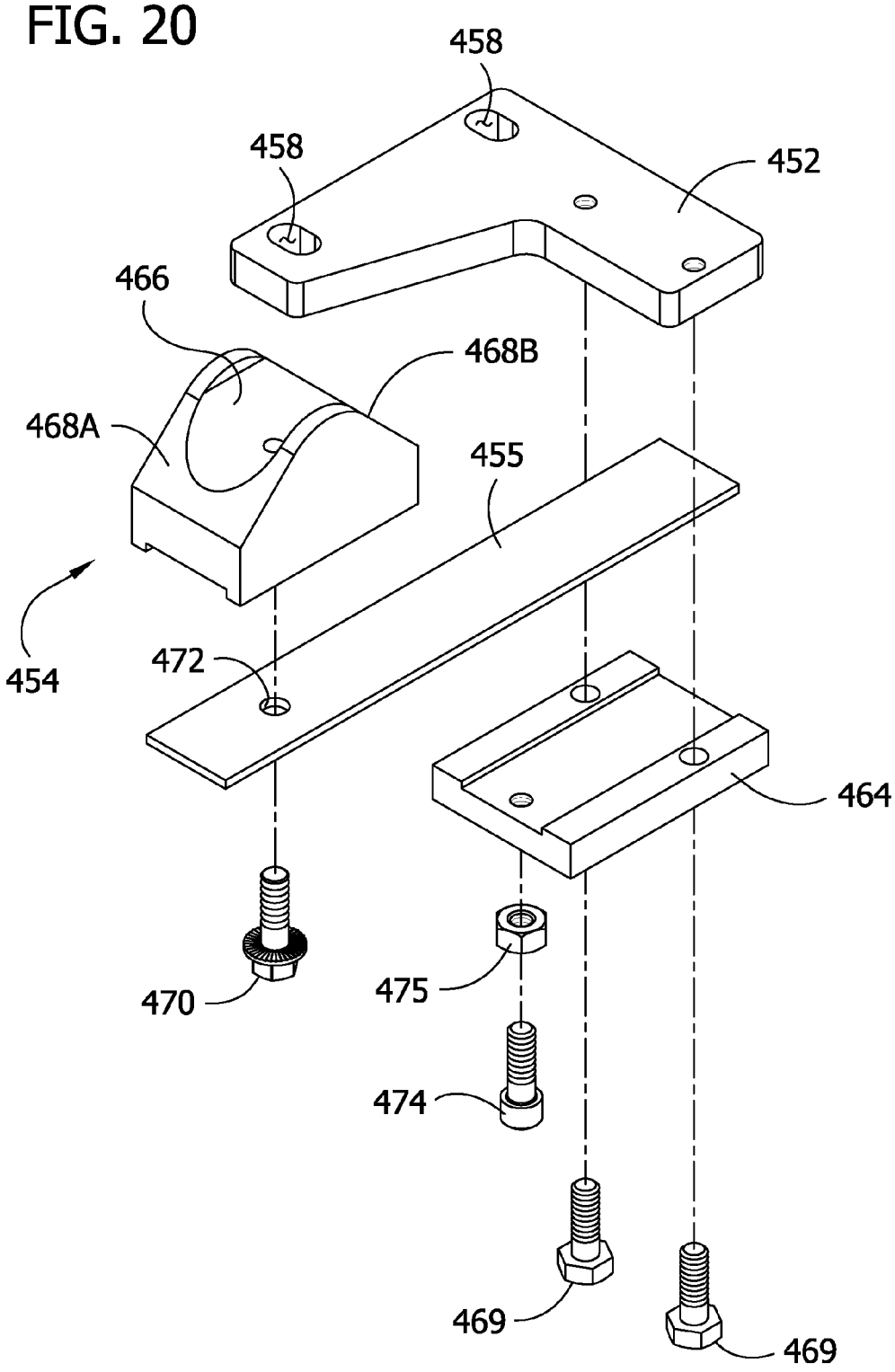
FIG. 20 is an exploded view of the rod-supporting assembly of FIG. 19.

Referring to FIGS. 16, 19 and 20, the saddle block 454 has a concave, upper support surface 466 extending longitudinally through upwardly sloping front and rear faces 468A, 468B of the block. The support surface 466 partially receives a longitudinal portion of the rod 328 therein, and may, for example, extend about 180 degrees around a circumference of the rod. The concave shape of the support surface 466 retains the rod 328 in the saddle 454 as the rod 328 rotates so that the saddle continuously engages and supports the rod as the rod rotates during use. Thus, the linearity of the rod is maintained during use and allows the rods to be rotated at higher rates. The saddle may be formed from NYLATRON, although it may be made from other materials.

As seen best in FIGS. 19 and 20, a first end of the cantilever bar 455 is secured to the base plate 452 using a compression plate 464 secured to the base plate using fasteners 469 (e.g., bolts) so that the bar is sandwiched between the base plate and the compression plate. The cantilever bar 455 is secured to a bottom of the saddle block 454 by a threaded fastener 470 (e.g., bolt, FIG. 20) extending through a hole 472 in the bar 455 and threaded into the block. The cantilever bar 455 may be formed from metal or other material. A tension-adjustment member 474 is threaded through a nut 475 and a bottom of the compression plate 464 and contacts a bottom of the cantilever bar 455. Selectively setting the length of the tension-adjustment member 474 extending above the compression plate 464 respectively decreases and increases the upward force of the bar 455 that is exerted on the rod 328.

Figure 21:
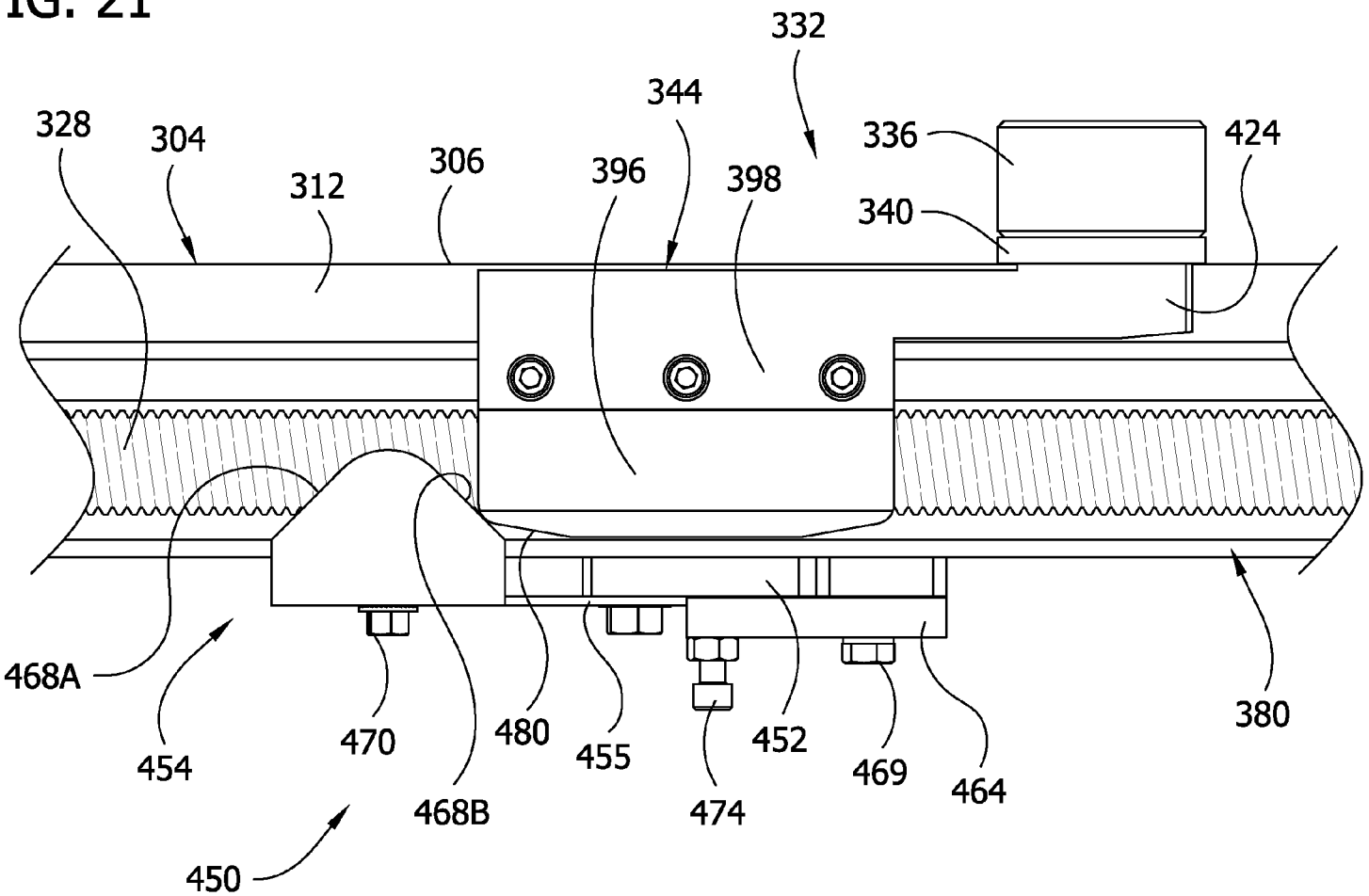
FIG. 21 is a fragmentary side elevation of the plank unit showing the puck carriage when it first contacts the rod-supporting assembly.
Figure 22:
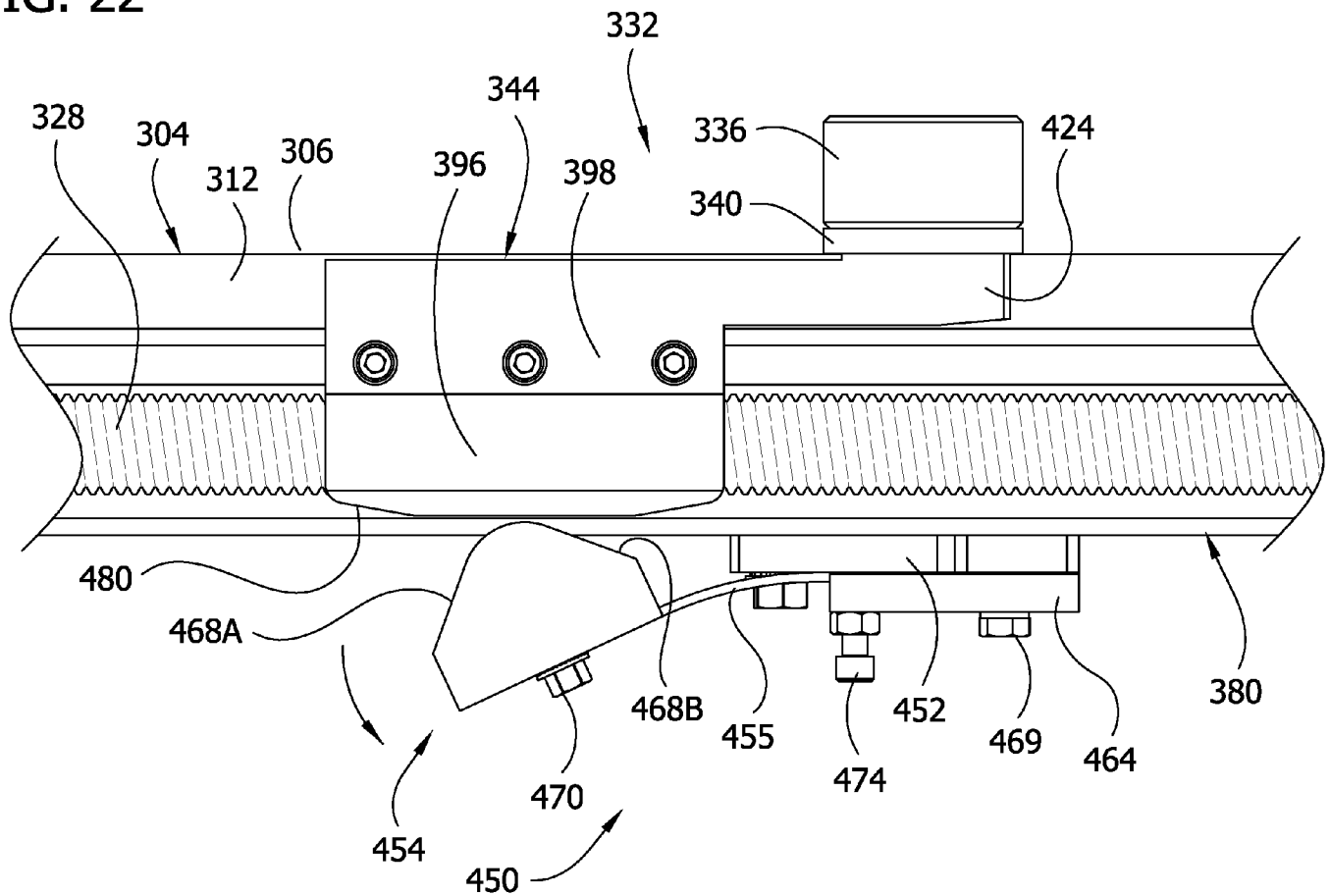
FIG. 22 is similar to FIG. 21 except that it shows the rod-supporting assembly being deflected downward as the puck carriage passes over the rod-supporting assembly.
Figure 23:
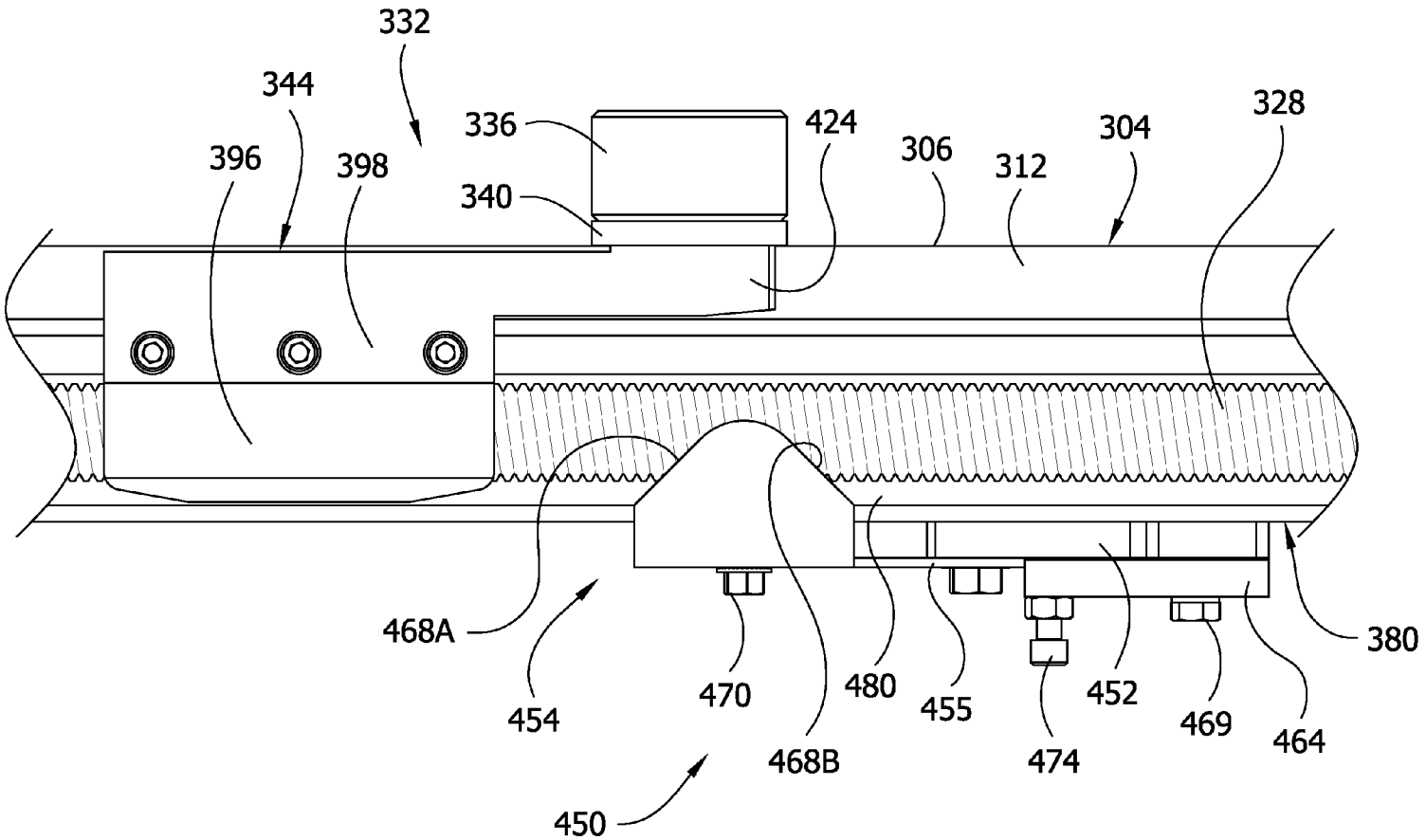
FIG. 23 is similar to FIG. 21 except that it shows the rod-supporting assembly and the puck assembly after the puck assembly has passed the rod-supporting assembly.

In addition to providing the upward force on the rod 328 to maintain the linearity of the rod, the resiliently flexible bar 455 allows the puck carriage 344 to move past the saddle block 454 as the puck carriage is moving longitudinally along the rod. Referring to FIGS. 21-23, a sequence of the puck carriage 344 passing the rod-supporting assembly 450 as the carriage is moving to the left along the rod 328 is illustrated. As will be appreciated by those skilled in the art, the sequence is substantially similar when the carriage 344 is moving to the right along the rod 328. In the position illustrated in FIG. 21, a beveled lead edge of the base 396 of the carriage 344 first contacts the sloped rear face 468B of the saddle block 454. Referring to FIG. 22, as the carriage 344 continues its movement, the force of the carriage deflects the cantilever bar 455 deflects so that the saddle block 454 moves downward. The upwardly sloping rear face 468B of the block 454 acts as ramp to allow a bottom surface 480 of the carriage base 396 to ride along the face of the block as the bar 455 continues to deflect and the block continues to move downward. The bottom surface 480 of the carriage base 396 slopes from each of the front and rear ends toward the center of the base to further facilitate engagement with the saddle block 454. After the puck carriage 344 moves past the saddle block (FIG. 23), the bar elastically rebounds and the saddle 454 moves upward, back to its original position of engagement with the rod 328. Accordingly, where each bar 328, 326 has two or more rod-supporting assemblies 450 associated with it, each rod is continuously supported and retained within at least one of the saddles, thus maintaining the linearity of the rod and prohibiting the rod from deflecting as it rotates.

Removable plank units 102, 202 may also be packaged in a truss assembly jigging table automated retrofitting kit. Such a kit includes one or more removable plank units 102, 202 and may include a plurality of fasteners for affixing removable plank units 102, 202 to a truss assembly jigging table, tools necessary for removing planks and inserting removable plank units 102, 202, cords for connecting removable plank units 102, 202 to a power system and a computer control system, and/or software to be installed on a computer control system. Removable plank units 102, 202 may come fully assembled, as shown in FIGS. 1-3, or may come disassembled so that the number, location, and configuration of the various components, such as drive motors, rods, and puck assemblies, can be varied upon assembly as required for a particular application.

As may be apparent from the above description of the illustrated embodiment, an advantage of the preferred embodiment is increased efficiency and cost savings. Removable plank units allow a manual truss assembly jig setting table to be quickly converted into an automated table. This increases the speed and efficiency of truss assembly. In addition, a significant capital expenditure is saved by converting the old tables into automated tables, rather than having to throw out the old tables and purchase completely new ones.

Another advantage of the illustrated embodiment is flexibility. Because of the removable nature of removable plank units, varying numbers of such segments may be used at any one time. The width of segments and the distance between segments may also be varied. This allows different numbers and configurations of puck assemblies to be used depending on the requirements of a particular truss.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above constructions, products, and methods without departing from the scope of the invention, it is intended that all matter contained in the above description and shown in the accompanying drawings shall be interpreted as illustrative and not in a limiting sense.

What is claimed is:

1. A plank unit for use with a truss assembly jigging table, comprising:

a plank having a generally planar top surface;

a drive motor secured to the plank, the drive motor having a rotating output member; and a puck assembly secured to the plank including a puck extending above the top surface of the plank, the puck assembly being operatively coupled to the rotating output member of the motor so that rotational movement of the output member produces translational movement of the puck assembly lengthwise along the top surface of the plank;

the plank, the drive motor, and the puck assembly being a self-contained unit.

2. The plank unit of claim 1 further comprising a threaded rod operatively connected to the output member of the motor so that rotational movement of the output member produces rotational movement of the rod about its longitudinal axis, the puck assembly being operatively connected to the threaded rod so that the puck moves translationally along the rod as the rod rotates about its longitudinal axis.

3. The plank unit of claim 2 further comprising a plate member extending downward from the plank generally adjacent to one end of the plank, the drive motor being secured to the plate member.

4. The plank unit of claim 3 wherein the threaded rod is rotatably coupled to the plate member so that the rod extends lengthwise along the plank.

5. The plank unit of claim 2, wherein the threaded rod constitutes a first threaded rod, the drive motor constitutes a first drive motor and the puck assembly constitutes a first puck assembly, the plank unit further comprising:

a second drive motor secured to the plank, the drive motor having a rotating output member;

a second threaded rod operatively coupled to the output member of the second drive motor so that rotational movement of the output member produces rotational movement of the second rod about its longitudinal axis, a second puck assembly including a puck extending above the top surface of the plank, the second puck assembly being operatively coupled to the second threaded rod so that the puck moves translationally along the rod as the rod rotates about its longitudinal axis.

6. The plank unit of claim 5 wherein the first puck assembly is movable along a first lateral side surface of the plank and the second puck assembly is movable along a second lateral side surface of the plank.

7. The plank unit of claim 6 further comprising a first plate member extending downward from the plank generally adjacent to a first longitudinal end of the plank, and a second plate member extending downward from the plank generally adjacent to an opposite, second longitudinal end of the plank, the first and second rods extending between and being operatively coupled to the first and second plate members.

8. The plank unit of claim 7 wherein the first motor is secured to the first plate member and the second motor is secured to the second plate member.

9. The plank unit of claim 2 further comprising at least one rod-supporting assembly disposed between end margins of the rod for providing support to the rod.

10. The plank unit of claim 9 wherein the rod-supporting assembly is adapted to allow the puck assembly to contact and move past the rod-supporting assembly as the puck assembly moves linearly along the rod.

11. The plank unit of claim 1, further comprising a pulley system operatively connecting the output member of the drive motor to the rod to effect rotational motion of the rod.

12. The plank unit of claim 1 further comprising a strut secured to a bottom surface of the plank, the strut providing support to the plank to resist bending of the plank when a vertical load is applied and being operatively coupled to the puck assembly to act as a guide for the puck assembly as the puck assembly moves lengthwise along the plank.

13. The plank unit of claim 1 wherein the puck assembly further comprises a spring for connecting the puck to the puck assembly to permit resilient movement of the puck relative to the puck assembly.

14. The plank unit of claim 1 wherein the drive motor and puck assembly are mounted in supporting relation on the plank so that the drive motor and puck assembly remain assembled when supported solely by the plank independently of the truss assembly jigging table.

15. The plank unit of claim 1 further comprising a motor plate affixed to a bottom surface of the plank, the drive motor being affixed to the motor plate.

16. The plank unit of claim 15 further comprising a rod attached to the output member of the drive motor and to the puck assembly, the motor plate including a bearing mounting the rod on the motor plate.

17. A truss assembly jigging table comprising:

a table frame; and a plurality of plank units held within the table frame, wherein at least one plank unit is a removable plank unit, the removable plank unit comprising:

a plank comprising a top surface and opposing bottom surface, first and second opposing side surfaces and first and second opposing ends;

a plate member extending outwardly from the bottom surface of the plank;

a rod attached to the plate member and running lengthwise along the plank;

a drive motor attached to the plate member configured to rotate the rod; and a puck assembly secured to the plank and carried by the rod such that translational motion of the puck assembly is effected when the rod is rotated;

the plank, the drive motor, and the puck assembly being a self-contained unit.

18. The truss assembly jigging table of claim 17, wherein the removable plank unit is connected to the table by way of fasteners inserted through apertures extending through the plank from top surface to bottom surface.

19. The truss assembly jigging table of claim 17, further comprising a power system operatively connected to the removable plank unit.

20. The truss assembly jigging table of claim 19, further comprising a computer control system operatively connected to the removable plank unit.

21. The truss assembly jigging table of claim 20, further comprising a laser projection system which is configured to project a laser image onto the table.

22. The truss assembly jigging table of claim 21, wherein the laser image is configured to display the location of truss members onto the table.

23. The truss assembly jigging table of claim 20, wherein the laser projection system is operatively connected to the computer control system.

24. A plank unit for use with a truss assembly jigging table, comprising:

a plank having a generally planar top surface;

a drive motor secured to the plank, the drive motor having a rotating output member; and a puck assembly including a puck extending above the top surface of the plank, the puck assembly being operatively coupled to the rotating output member of the motor so that rotational movement of the output member produces translational movement of the puck assembly lengthwise along the top surface of the plank;

the puck assembly further comprising a spring for connecting the puck to the puck assembly to permit resilient movement of the puck relative to the puck assembly.

* * * * *